US006830226B2

(12) United States Patent
Field et al.

(10) Patent No.: US 6,830,226 B2
(45) Date of Patent: Dec. 14, 2004

(54) QUICK RELEASE SUPPORTING APPARATUS FOR A CANISTER

(75) Inventors: Bradley J. Field, Kelowna (CA); Joseph Konrat, Kelowna (CA)

(73) Assignee: Pacific Safety Products Inc., Kelowna (CA)

( * ) Notice: Subject to any disclaimer, the term of this patent is extended or adjusted under 35 U.S.C. 154(b) by 0 days.

(21) Appl. No.: 10/725,486

(22) Filed: Dec. 3, 2003

(65) Prior Publication Data

US 2004/0108429 A1 Jun. 10, 2004

Related U.S. Application Data

(63) Continuation-in-part of application No. 10/373,176, filed on Feb. 26, 2003, now Pat. No. 6,736,363, which is a continuation of application No. 10/046,577, filed on Jan. 16, 2002, now Pat. No. 6,543,736.

(60) Provisional application No. 60/261,205, filed on Jan. 16, 2001.

(51) Int. Cl.[7] ..... A47K 1/08

(52) U.S. Cl. ..... 248/313

(58) Field of Search ..... 248/313, 311.2, 248/317, 686, 689

(56) References Cited

U.S. PATENT DOCUMENTS

| | | | | | |
|---|---|---|---|---|---|
| 2,615,238 | A | * | 10/1952 | Highwood | 269/9 |
| 3,240,407 | A | * | 3/1966 | Boak | 224/42.38 |
| 3,310,270 | A | * | 3/1967 | Ciancio | 248/210 |
| 3,817,435 | A | * | 6/1974 | De Luca et al. | 294/165 |
| 4,383,528 | A | * | 5/1983 | Eppolito | 128/205.22 |
| 4,438,764 | A | * | 3/1984 | Eppolito | 128/205.22 |
| 4,586,687 | A | * | 5/1986 | Ziaylek, Jr. | 248/313 |
| 4,606,521 | A | * | 8/1986 | Williams | 248/214 |
| 4,770,428 | A | * | 9/1988 | Sugiyama | 280/834 |
| 4,848,714 | A | * | 7/1989 | Ziaylek et al. | 248/313 |
| 4,860,986 | A | * | 8/1989 | Couzens | 248/313 |
| 5,039,902 | A | * | 8/1991 | Schwarz | 312/248 |
| 5,067,626 | A | * | 11/1991 | Leumi | 220/475 |
| 5,071,100 | A | * | 12/1991 | Sweeny | 248/313 |
| 5,098,054 | A | * | 3/1992 | Dyer | 248/313 |
| 5,123,409 | A | * | 6/1992 | Sheffield et al. | 128/204.18 |
| 5,249,702 | A | * | 10/1993 | Topp et al. | 220/705 |
| 5,288,001 | A | * | 2/1994 | Locarno | 224/407 |
| 5,335,954 | A | * | 8/1994 | Holub et al. | 294/31.2 |
| 5,354,029 | A | * | 10/1994 | Ziaylek et al. | 248/313 |
| 5,362,022 | A | * | 11/1994 | McLoughlin et al. | 248/313 |
| 5,472,167 | A | * | 12/1995 | Shillington et al. | 248/552 |
| 5,810,309 | A | * | 9/1998 | Augustine et al. | 248/313 |
| 5,887,836 | A | * | 3/1999 | Back | 248/221.11 |
| 6,059,245 | A | * | 5/2000 | Hermansen et al. | 248/311.2 |
| 6,170,518 | B1 | * | 1/2001 | Ratelle | 137/376 |
| 6,543,736 | B2 | * | 4/2003 | Field | 248/313 |

* cited by examiner

*Primary Examiner*—Leslie A. Braun
*Assistant Examiner*—A. Joseph Wujciak
(74) *Attorney, Agent, or Firm*—Antony C. Edwards

(57) ABSTRACT

A quick release canister supporting apparatus includes a mounting bracket mountable to a rigid support, a rigid, canister retaining frame releasably mountable into mating engagement with the mounting bracket, and at least one latch cooperating between the mounting bracket and the retaining frame for the releasable mounting into mating engagement of the retaining frame with the mounting bracket. The latch may be mounted to the mounting bracket or to the retaining frame. A manually operable release actuator may cooperate with the latch for selective actuation of the latch to release the retaining frame from the mounting bracket. The retaining frame defines a rigid cavity having an opening for receiving a gas canister substantially completely into the cavity.

11 Claims, 37 Drawing Sheets

QUICK RELEASE SUPPORTING APPARATUS FOR A CANISTER

CROSS REFERENCE TO RELATED APPLICATION

This application is a Continuation-in-Part of U.S. patent application Ser. No. 10/373,176 filed Feb. 26, 2003 now U.S. Pat. No. 6,736,363 which is a continuation of U.S. patent application Ser. No. 10/046,577 filed Jan. 16, 2002, now U.S. Pat. No. 6,543,736, which claims priority from U.S. Provisional Patent Application No. 60/261,205 filed Jan. 16, 2001 entitled Quick Release Supporting Apparatus for a Canister.

FIELD OF THE INVENTION

This invention relates to an apparatus for releasably mounting a cylindrical oxygen canister for rapid deployment and use.

BACKGROUND OF THE INVENTION

There are many examples, one of which is an emergency response vehicle, where it is desirable to have a cylindrical gas canister, such as an oxygen or fire retardant canister, mounted so as to be out of the way, and whereso mounted ready for rapid deployment and use. Other examples may include medical emergency rooms, or other static or mobile facilities whether medical or otherwise.

In the emergency vehicle example, such vehicles are often required to transport canisters containing pressurized gaseous substances such as air, oxygen or fire suppressant materials. Such canisters generally have at one end of the canister end fittings such as valves and pressure regulators or the like which can become damaged. These types of canisters may be generally cylindrically shaped and if left free standing may be relatively easily knocked over. When such canisters are transported by emergency vehicles a suitable means of restraint is needed to secure the canisters within the vehicle in a manner which permits rapid release of the canister for use. It is also preferable to provide for ease of carrying by emergency personnel and for stable deployment of the canister at the destination.

In the prior art applicant is aware of U.S. Pat. No. 5,354,029 which discloses a frame mountable within an emergency vehicle. The frame has two pairs of spaced apart 'clam shell' clamps, operable by a lever, and designed to engage a back-pack style of air tank such as is normally worn by fire-fighters while seated within an emergency vehicle. Placement of the cylinder within the device is cumbersome; and the device does not permit emergency personnel to easily carry the cylinder to the point of use, nor does it provide a means of stable deployment for the cylinder on the ground at the point of use.

Thus, it is an object of the present invention to provide a latching means for releasable mounting of cylindrical canisters which allows ease of insertion, automatic locking and a one hand operated quick release mechanism.

Further, without intending to be limiting, an additional object of this invention is to provide a retaining assembly which can be readily secured to a canister, which will facilitate rapid mating engagement of the canister with the quick release mechanism and which may provide both a carrying and supporting apparatus for the canister.

As used herein, reference to canister is intended to include reference to tank, cylinder or like references to containers for pressurized gas.

SUMMARY OF THE INVENTION

The quick release of the quick release supporting apparatus of the present invention may include both a bracket and a latch. The latch may have a latch pawl mounted intermediate the ends of a spindle so as to be rotatably nested within a latch receiving arm of the bracket. A manually operable lever arm may be provided to rotate the latch pawl into an open position. The lever arm may be operable by depressing a button mounted to the arm or by pulling a handle mounted to the arm or by other biasing devices for rotating the lever arm or for operating the latch pawl. A cover may be mounted over the bracket and latch mechanism. Spaced apart aligned apertures in the cover permit the supporting arm and latch receiving arm to protrude through.

A canister retaining frame may have upper and lower annular collars or clamps for receiving therein a gas canister. The collars may each have a protrusion, for example opposite the latch when the retaining frame is mounted therein, for supporting a longitudinal tubular handle therebetween. Outwardly extending arms on each collar, which may be oppositely disposed relative to the protrusions, form a pair of forks or yokes. A pin is mounted across each fork or yoke. In one embodiment where the collars provide for clamping of the canister, the pin in each yoke is fixed in one arm of the yoke, and is slidably journalled through the other arm. An over-center cam faced lever is mounted to the outer end of the pin. The arms of the yoke allow tightening of the collar around the canister by the clamping action of the cam lever. The upper and lower annular collars are spaced apart along the canister so as to better support the canister and to allow the corresponding upper and lower pins to engage and mate with the latch receiving arm and a support arm, respectively, formed on opposite ends of the bracket.

A transverse handle and regulator guard frame combination, collectively referred to herein as a regulator guard, may be mounted to the upper end of the oxygen canister retaining frame. The guard is a rigid frame protecting the regulator and providing for ease of grasping and manipulating the end of the canister when in the retaining frame. By way of example, the guard frame may be of tubular material and may be rectangular or may be curved so as to loop around the circular circumferential profile of the canister.

Supporting legs, which automatically deploy when an end of the canister retaining frame is placed in contact with a firm surface, may be pivotally mounted on the canister retaining frame, for example between the upper and lower collars. Placing the retaining frame on the firm surface drives linkage arms upwardly. The linkage arms are rotatably mounted to the supporting legs so as to pivot the supporting legs outwardly of the retaining frame as the linkage arms are translated upwardly relative to the retaining frame.

In summary, the quick release canister supporting apparatus of the present invention includes a mounting bracket mountable to a rigid support, a rigid, canister retaining frame releasably mountable into mating engagement with the mounting bracket, and at least one latch cooperating between the mounting bracket and the retaining frame for the releasable mounting into mating engagement of the retaining frame with the mounting bracket. The latch may be mounted to the mounting bracket or to the retaining frame. A manually operable release actuator cooperates with the latch for selective actuation of the latch to release the retaining frame from the mounting bracket. The retaining frame defines a rigid cavity having an opening for receiving a gas canister substantially completely into the cavity. The retaining frame includes at least one selectively releasable canister rotation restraint for inhibiting rotation and sliding of the canister about and along its longitudinal axis. At least one selectively releasable canister ejection restraint may also be provided for inhibiting sliding ejection of the canister from the cavity.

A portion of the retaining frame, which may be oriented generally opposite the mounting bracket when the retaining frame is mounted to the mounting bracket, provides a carry handle for carrying of the retaining frame by a user when the canister is mounted in the cavity and the retaining frame is dismounted from the mounting bracket. A rigid regulator guard is mounted to the retaining frame at a first end of the retaining frame corresponding to the opening to the cavity. The guard extends over the opening so as to protect a gas flow regulator mounted on the canister.

In one embodiment, the latch is mounted to the mounting bracket and is a single upper latch disposed substantially vertically above a support arm extending from the bracket, where the support arm is adapted to releasably engage and support a lower end of the frame. An upper end of the retaining frame is adapted to releasably engage the latch.

The frame may include first and second collars, mounted in or to or forming part of the retaining frame. The collars are parallel and spaced apart. Corresponding first and second apertures defined by the collars are co-axial along a longitudinal axis of the canister when mounted journalled in the collars. Rigid, parallel first and second cross-members may be mounted to the first and second collars respectively. The first and second cross members are for releasable mating with the latch and the supporting arm respectively.

The latch may be mounted to the mounting bracket so as to protrude cantilevered therefrom. Thus, where the mounting bracket mounts to a rear surface of a rigid support such as a wall or mounting plate, and the rigid support is apertured so that the latch may extend through corresponding apertures in the wall to protrude from the opposite front surface of the wall, the front surface of the wall is adapted for releasable latched mating with the rigid frame.

The mounting plate may be an angled wall mount adapted for mounting to the wall. The mounting bracket may then be mounted to the wall mount along a surface of the wall mount inclined relative to the wall so as to incline the retaining frame towards and along the wall when the retaining frame is mounted to the mounting bracket.

A resilient compression fit auxiliary latch may be provided cooperating with the latch so as to provide a safety backup latch for controlled release of the retaining frame from mounting to the mounting bracket.

DETAILED DESCRIPTION OF EMBODIMENTS OF THE INVENTION

Figure 2:
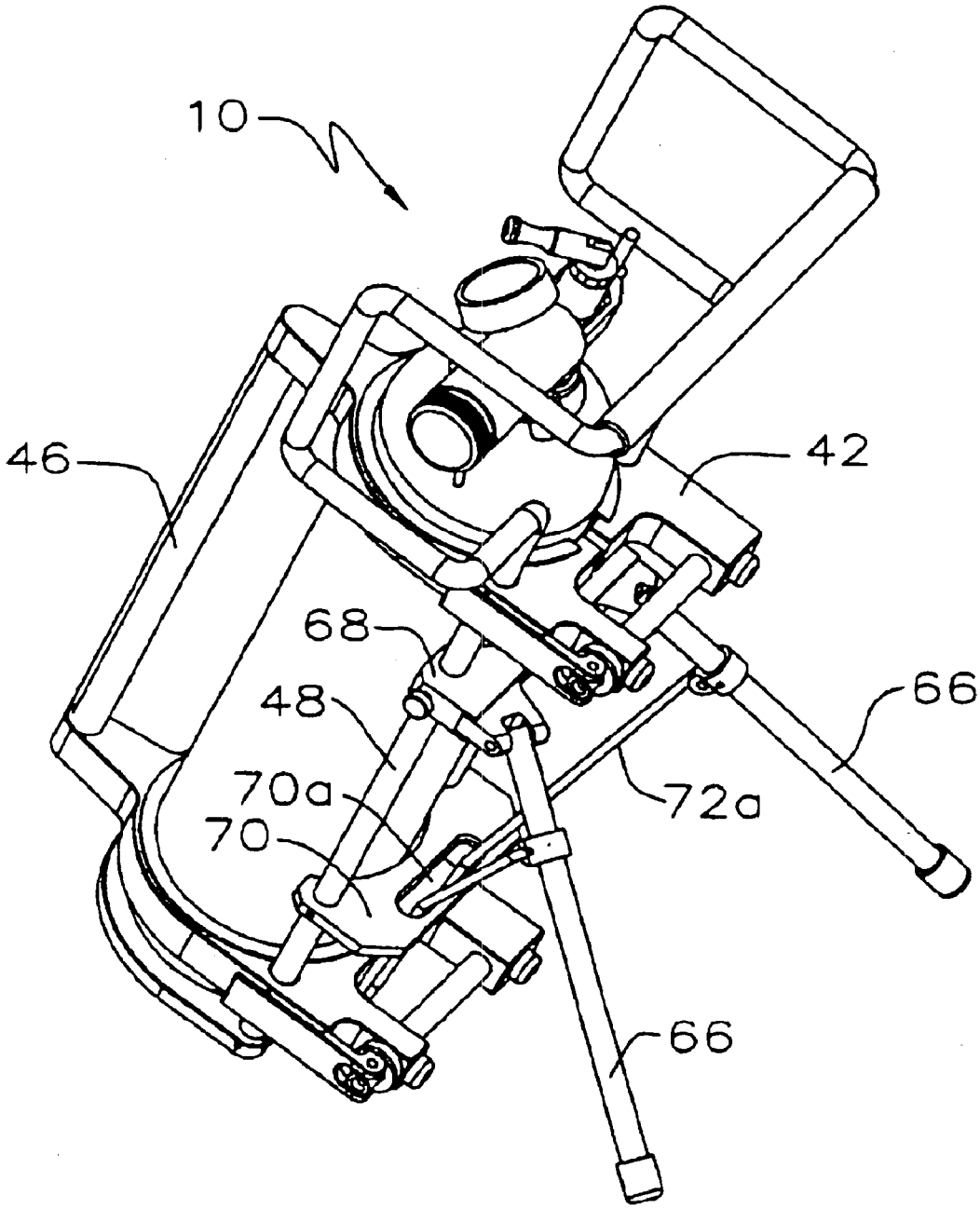
FIG. 2 is an isometric view of the present invention with the supporting legs in a deployed aspect.
Figure 3:
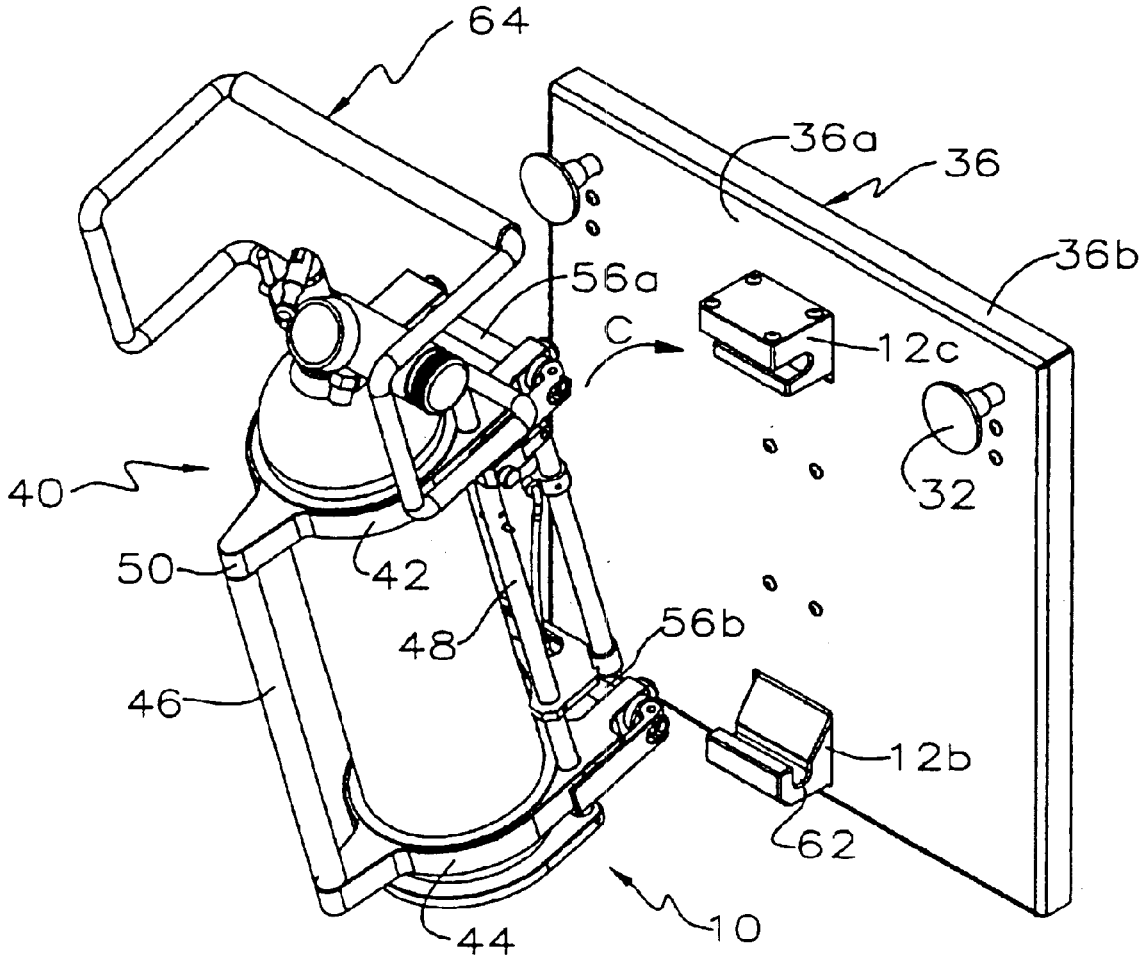
FIG. 3 is an isometric view of the present invention positioned in proximity to the mounting bracket and latching mechanism; portions of which are protruding through the cover plate.
Figure 4:
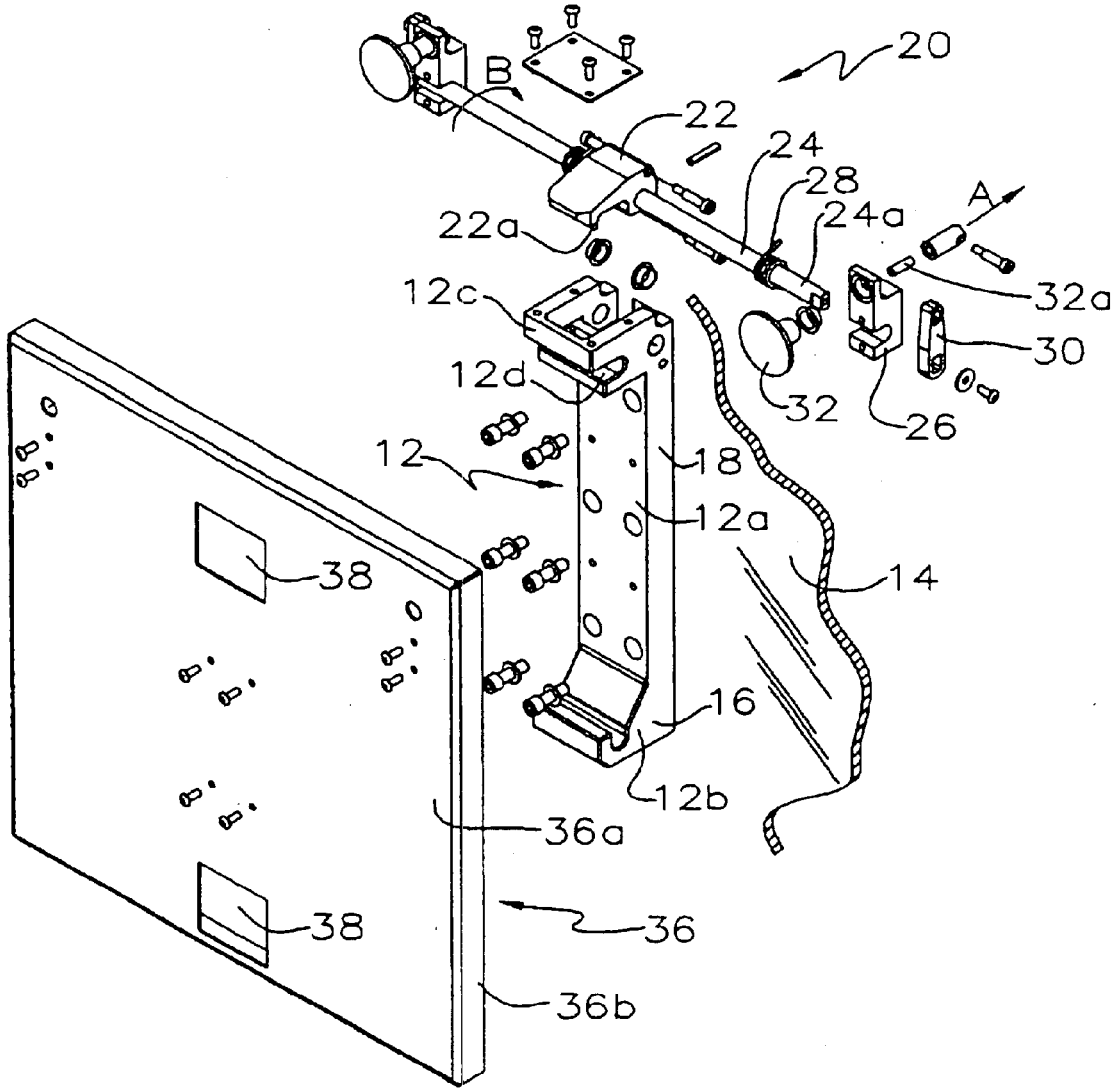
FIG. 4 is an exploded isometric view of the mounting bracket, latching mechanism and cover plate.
Figure 4D:
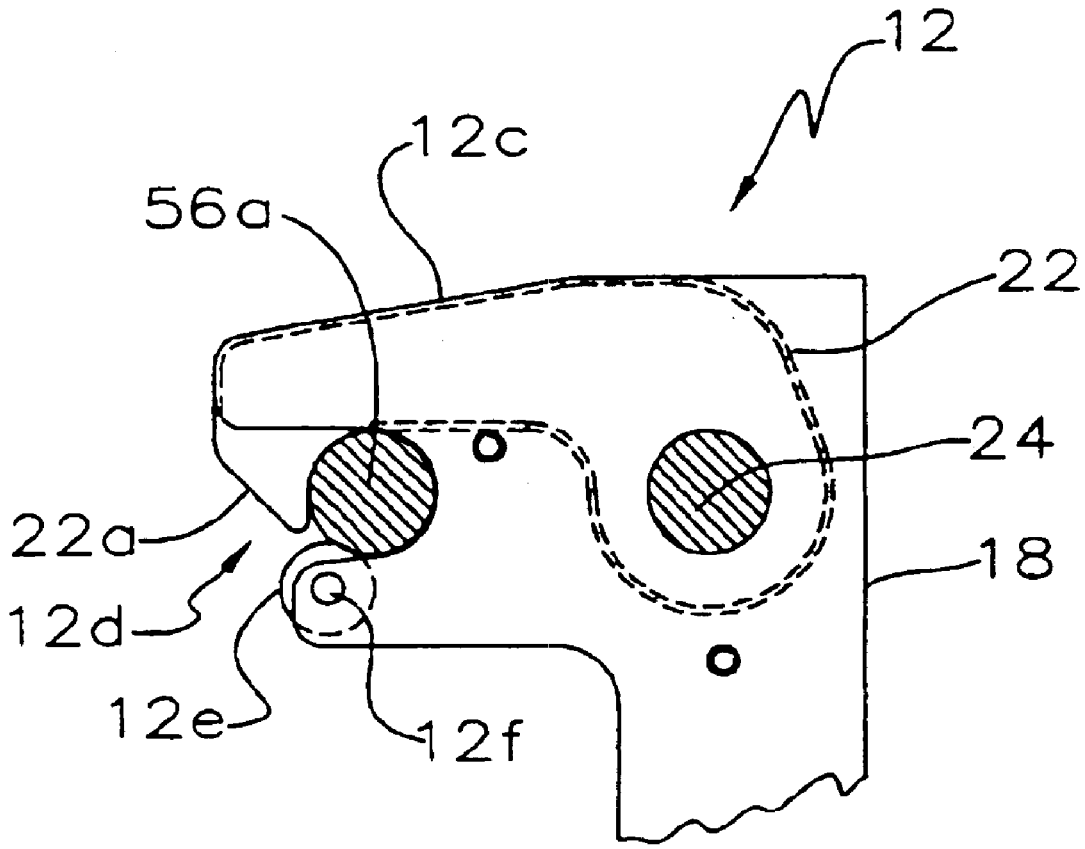
FIG. 4*a* is a sectional view of the latch pawl of the present invention.
FIG. 4*b* is a perspective view of the latch pawl of FIG. 4*a*.

With reference to the drawing figures wherein similar characters of reference denote corresponding parts in each view, as seen in FIGS. 1–4, in one embodiment a mounting bracket 12, better seen in FIG. 4, for mounting to an inside surface 14 of, for example, an emergency vehicle, provides for releasable mounting of canister support 10. Mounting bracket 12 may have an elongated body 12*a* which has formed at a first end 16, or mounted thereto, a cantilevered supporting arm 12*b*. Opposite second end 18 of body 12*a* has formed thereon or mounted thereto a cantilevered latch receiving arm 12*c*. Arms 12*b* and 12*c* may be cantilevered relative to elongated body 12*a* so as to generally extend at right angles from the mounting surface 14 when body 12*a* is mounted to surface 14. Alternatively, arms 12*b* and 12*c* may be independently mountable to surface 14 as separate parts, in which case each would have its own mounting bracket, plate or other attachment means (collectively referred to herein as a mounting bracket).

Figure 4B:
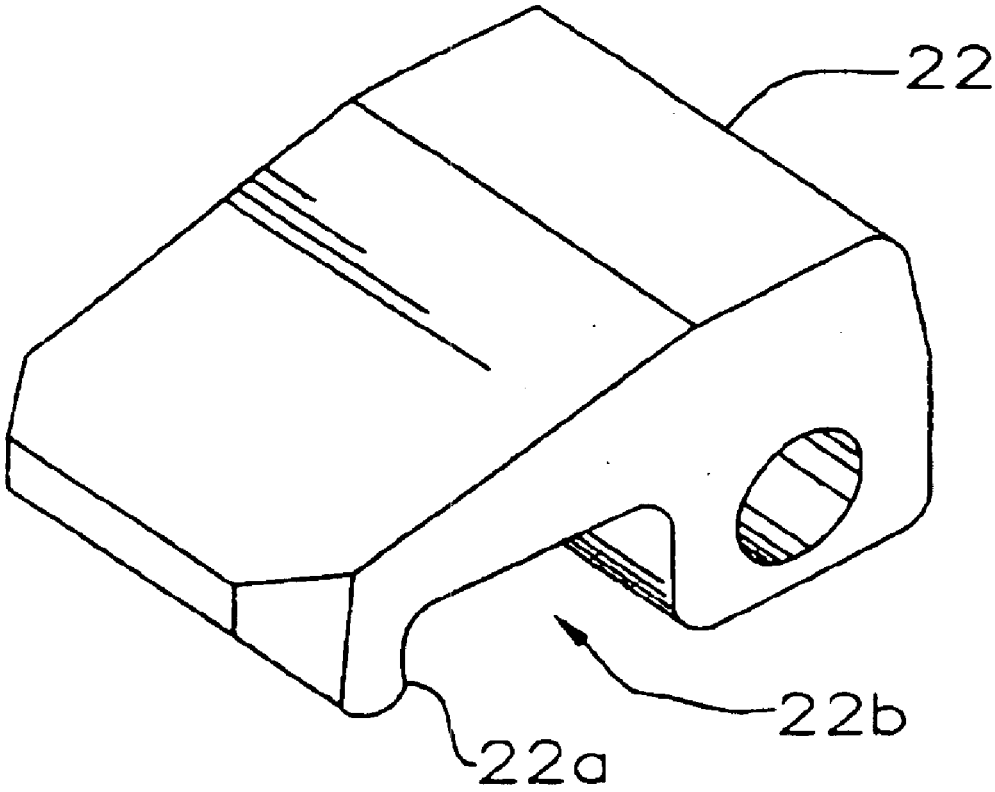

Latching mechanism 20 has a latch pawl 22 rigidly mounted to spindle 24, for example, intermediate the ends of spindle 24. Spindle 24 may be rotatably mounted to body 12*a* so as to rotatably nest pawl 22 within a cavity or recess in latch receiving arm 12*c*. Spindle 24 is rotatable against the return biasing force of springs 28 which rotationally urge latch pawl 22 into a closed position wherein pawl flange 22*a*, better seen in FIGS. 4*a* and 4*b*, is lowered into cavity or recess 12*d* in arm 12*c*. Spindle 24 is rotatably supported at its ends 24*a*, remote from the latch pawl 22, in end blocks 26 to allow free rotation of pawl 22. Release levers 30 are rigidly mounted to spindle 24 for example adjacent ends 24*a*. A release actuator such as release button 32 is mounted to shaft 32*a* which is rigidly slidably journalled through end blocks 26. Shaft 32*a* is pivotally mounted to release lever arm 30. As release lever arm 30 is rotated, such as when release button is depressed in direction A, the spindle and latch are rotated in direction B, against the return biasing force of helical biasing spring 28, to rotate latch pawl 22 into an open position wherein pawl flange 22*a* is raised or otherwise extracted from cavity 12*d* in arm 12*c*.

Resilient tube 12*e* is mounted on pin 12*f* between the lower forks of arm 12*c*. As better seen in FIG. 4*a*, pin 56*a* on retaining frame 40 snugly seats in recess 12*d* of arm 12*c* behind pawl flange 22*a*. Once pawl flange 22*a* is elevated to release the latch, allowing extraction of pin 56*a* from arm 12*c*, pin 56*a* must slightly compress tube 12*e* to pass outwardly from recess 12*d*. Tube 12*c* thus provides a safety catch. If latch pawl 22 is inadvertently actuated so as to raise pawl flange 22*a*, pin 56*a* will not merely fall out of recess 12*d*, which would then drop apparatus 10 from, for example, its wall mounting, but rather a user must then firmly pull pin 56*a* past the constriction in recess 12*d* which is smaller than the diameter of pin 56*a*, where the constriction is formed between resilient tube 12*e* and the lower edge of the upper fork of arm 12*c*.

A cover 36 having a face plate 36*a* and a perimeter lip 36*b* may be mounted over mounting bracket 12 and latching mechanism 20. Perimeter lip 36*b* spaces face plate 36*a* from surface 14 by, for example, approximately the thickness of the body 12*a*. Arms 12*b* and 12*c* extend through apertures 38 in face plate 36. Face plate 36*a* may thus be positioned in proximity to and mounted to mounting bracket 12 and end blocks 26, for example, by screws or the like.

With respect to canister retaining frame 40, upper and lower annular clamps 42 and 44 may be held in parallel alignment spaced apart along the length of canister or cylinder 60 by a means for carrying, such as tubular handle 46, and a pair of longitudinal spacing tubes 48. Annular clamps 42 and 44 may each have a radial protrusion 50 which mounts to the ends of tubular handle 46 and space the handle radially outwardly from the annular clamping surfaces of the clamps and align the handle parallel to the canister. A split 52 may be formed in each of the clamps opposite protrusion 50. A yoke 54 has arms 54*a* and 54*b* which may extend outwardly from the clamps on either side of the split 52. A pin 56 may be rigidly mounted at a first end in one arm 54*b* and slidably journalled at an opposite second end through the opposite arm 54*a*. An over-center cam lever 58 may be mounted to the second end of pin 56. Arms 54*a* and 54*b* may then be drawn together by rotating arm lever 58 so as to engage the cam on the lever against arm 54*a*. Drawing arms 54*a* and 54*b* together tightens the annular clamping surfaces of the clamps snugly around a gas cylinder 60.

The upper and lower annular clamps 42 and 44 respectively may be spaced apart by the handle 46 and hollow spacing tubes 48, or other spacers, a sufficient distance so as to position pins 56 for simultaneous or sequential mounting in latch receiving arm 12*c* and support arm 12*b*.

Lowermost pin 56*b* may be first placed in a receiving groove 62 formed in lower support arm 12*b*. The canister retaining frame 40 may then be pivoted in direction C on the lower pin 56*b* until upper pin 56*a* engages the rearward sloping leading face of pawl flange 22*a* of the latch pawl 22. Further rotation of canister retaining frame 40 forces pin 56*a* under pawl flange 22*a*, rotating the latch pawl 22 in direction B to its open position against the return torsion force of the biasing spring 28. As the upper pin 56*a* slides along cavity 12*d* past pawl flange 22*a* it aligns with and is engaged within cavity 22*b* in pawl 22 as seen in FIG. 4*a*. This allows latch pawl 22 to rotate to its closed position, that is, in a direction opposite to that of direction B, under the urging of biasing springs 28. This latches the retaining frame and associated canister firmly in place against the bracket.

Gas flow regulator guard 64 may be formed from hollow tubing and mounted to ends of hollow spacing tubes 48. The handle and guard frame 64 may extend around, so as to protect any valves, regulators, gauges or the like which are normally mounted on such canisters.

Legs 66 are supported by the hollow spacing tubes 48 on a leg support plate 68. Support plate 68 is positioned near the uppermost annular clamp 42 and is slidably mounted on the hollow spacing tubes 48. Support legs 66 are hinged to support plate 68 so as to swing outwardly from the canister retaining frame 40 on the side opposite to the tubular handle 46. A guide plate 70, positioned near lower annular clamp 44 on hollow spacing tube 48*a*, has a guide slot 70*a* through which an actuation plunger 72 extends. Actuation plunger 72 may be generally 'U' shaped and have drive rods 72*a* mounted thereto. Rods 72*a* are rotatably mounted to the support legs 66. When the base of canister retaining frame 40 is placed on a firm surface such as the ground, actuation plunger 72 contacts the firm surface and is pushed partially through guide slot 70*a* in guide plate 70 generally in a direction toward upper annular clamp 42. This drives rods 72*a* against legs 66 and results in support legs 66 rotating outwardly from the canister retaining frame 40 so as to support frame 40 in a generally upright, stable tripod position.

The automatic deploying of supporting legs 66 may be deactivated by repositioning the support plate 68, in a direction toward upper annular clamp 42, on hollow spacing tubes 48. Through such repositioning of support plate 68, actuation plunger 72 is elevated so as to avoid contact with a surface upon which canister retaining frame 40 may be placed.

Figure 5:
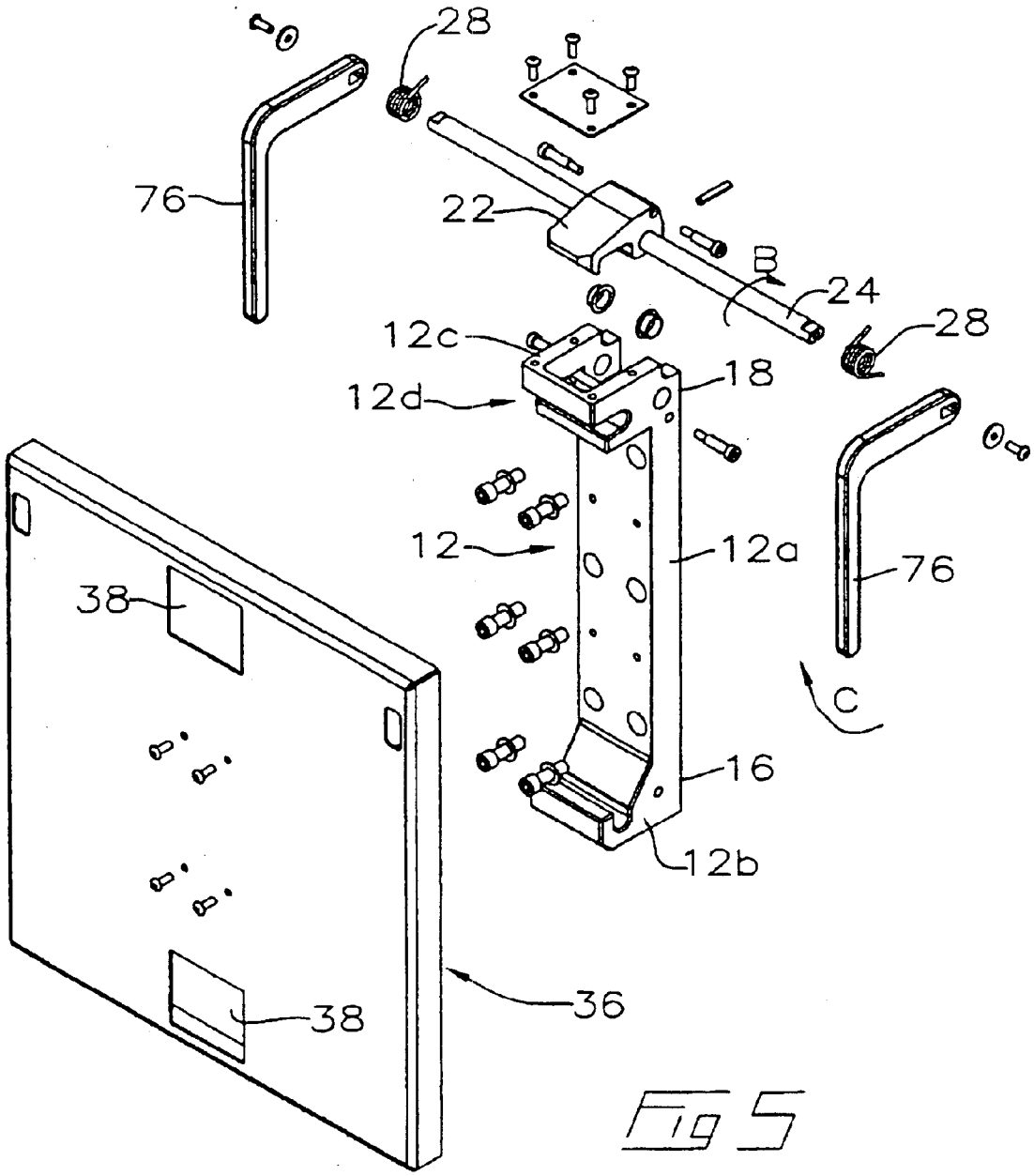
FIG. 5 is an exploded isometric view illustrating an alternative latch releasing mechanism.
Figure 5A:
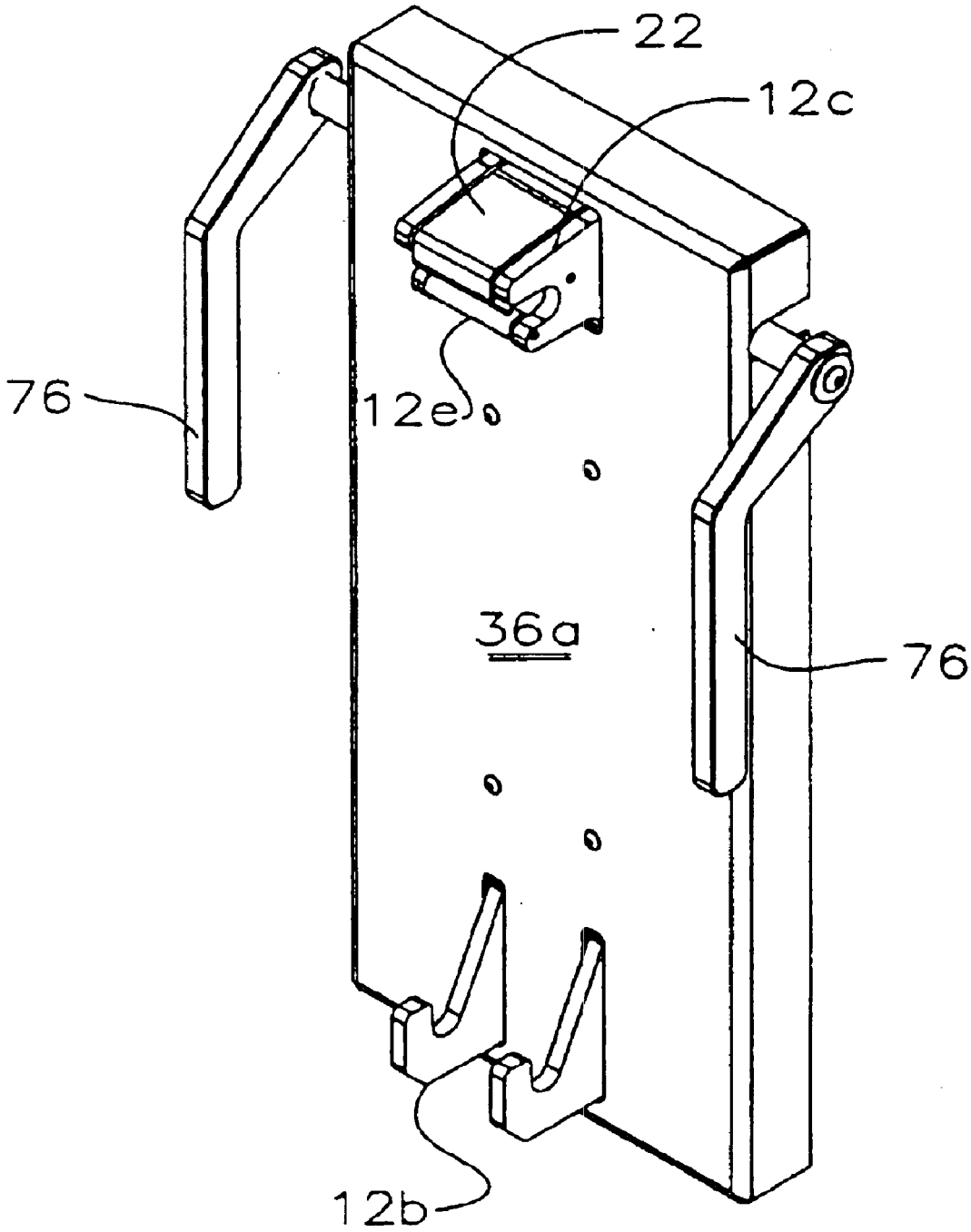
FIG. 5*a* is, in perspective view, an alternative embodiment of the mounting bracket of FIG. 5.
Figure 5B:
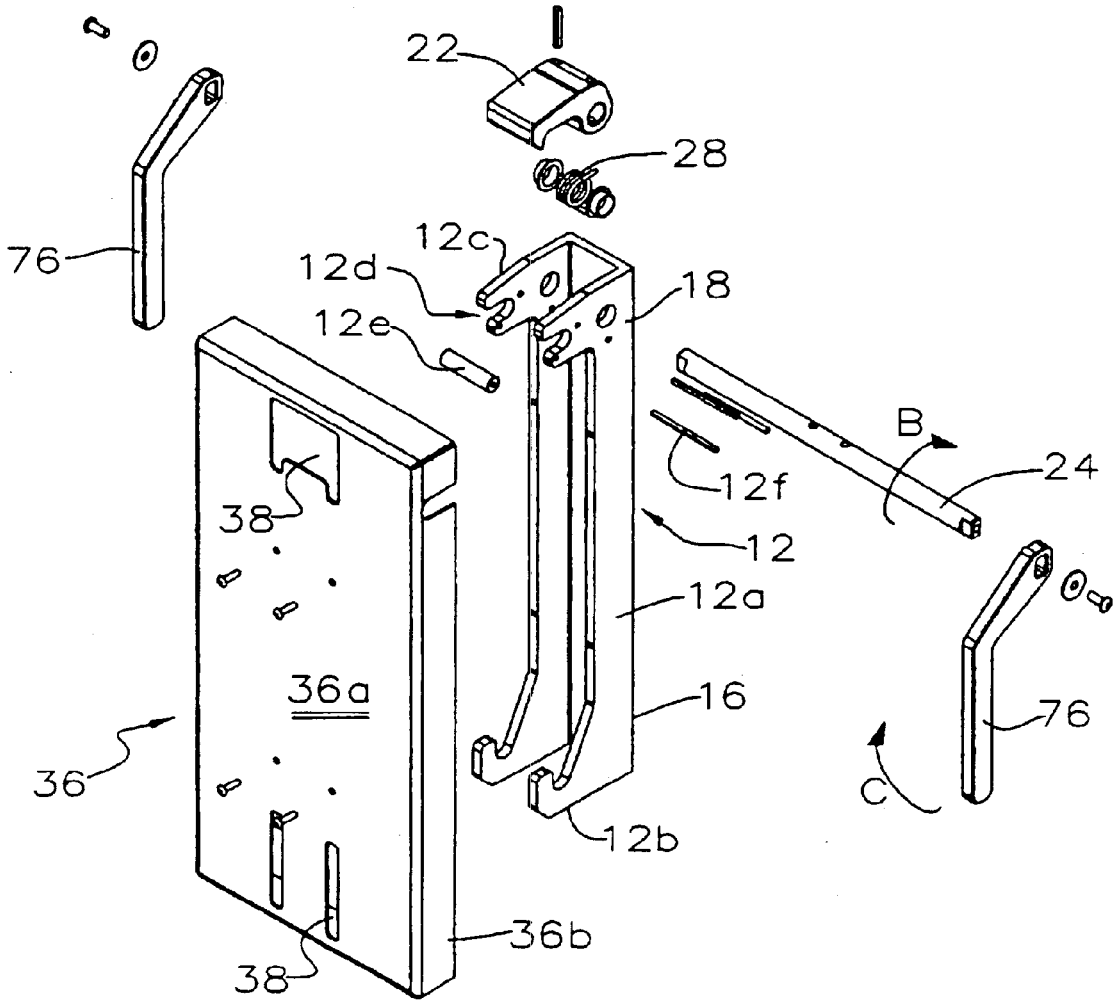
FIG. 5*b* is, in exploded view, the mounting bracket of FIG. 5*a*.
Figure 6:
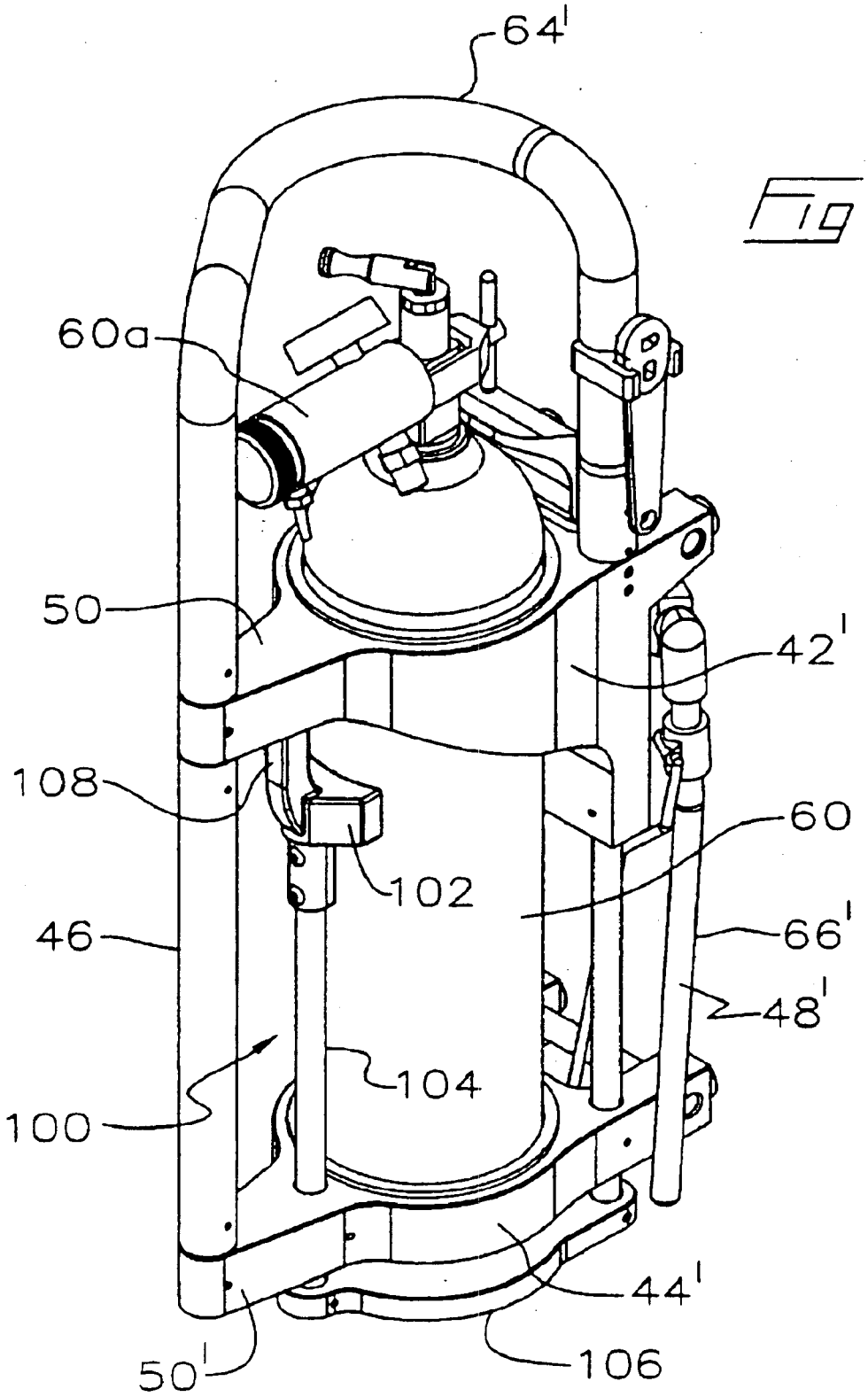
FIG. 6 is, in perspective view, an alternative embodiment of the canister retaining frame of FIG. 1.
Figure 7:
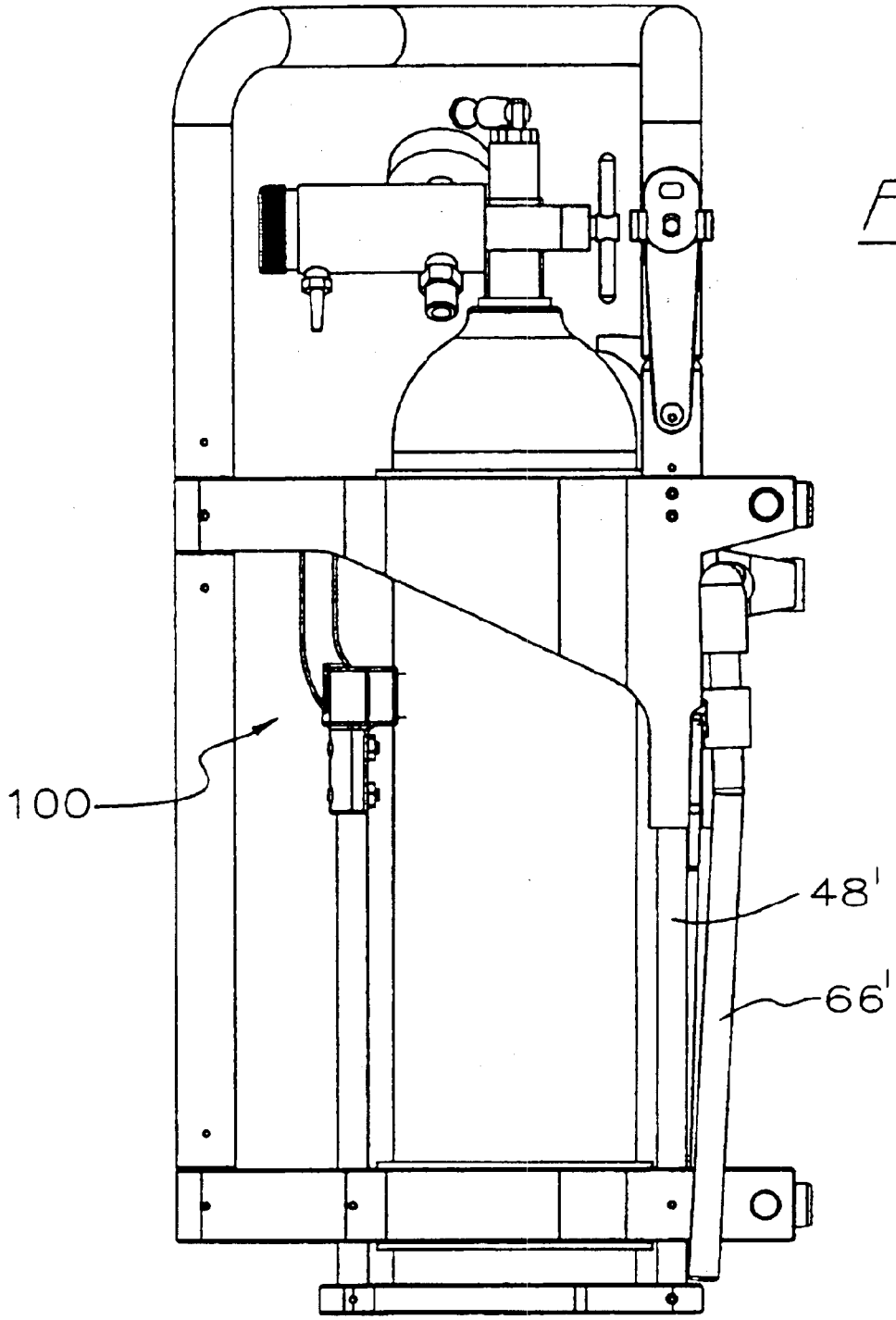
FIG. 7 is, in side elevation view, the canister retaining frame of FIG. 6.
Figure 8:
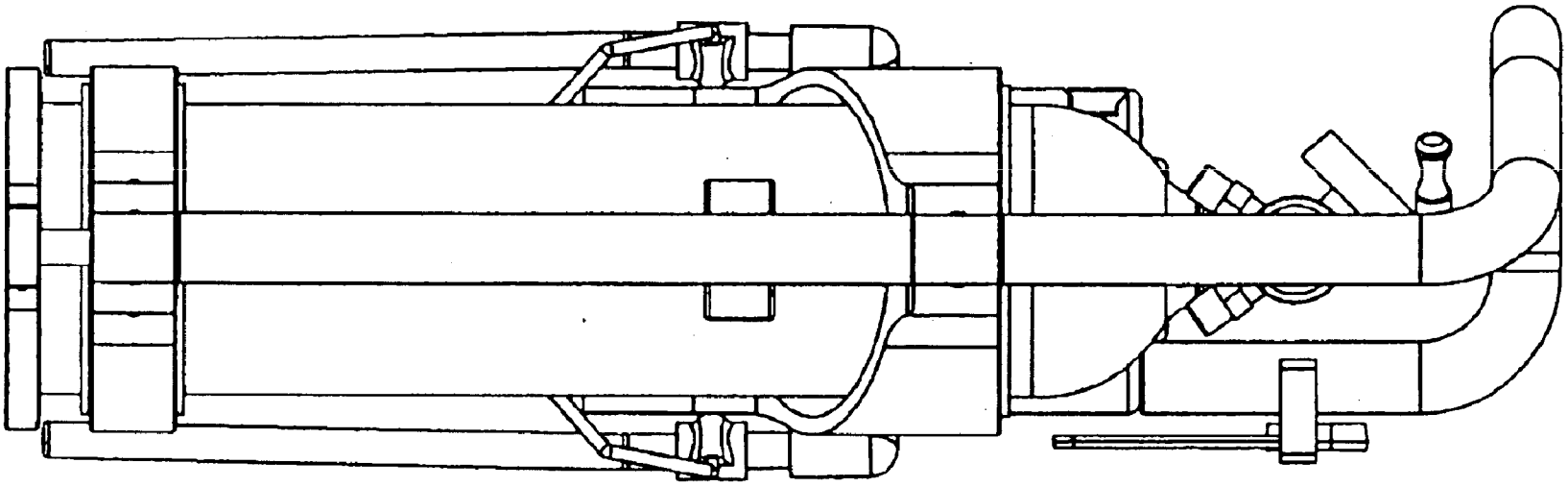
FIG. 8 is, in front elevation view, the canister retaining frame of FIG. 6.
Figure 9:
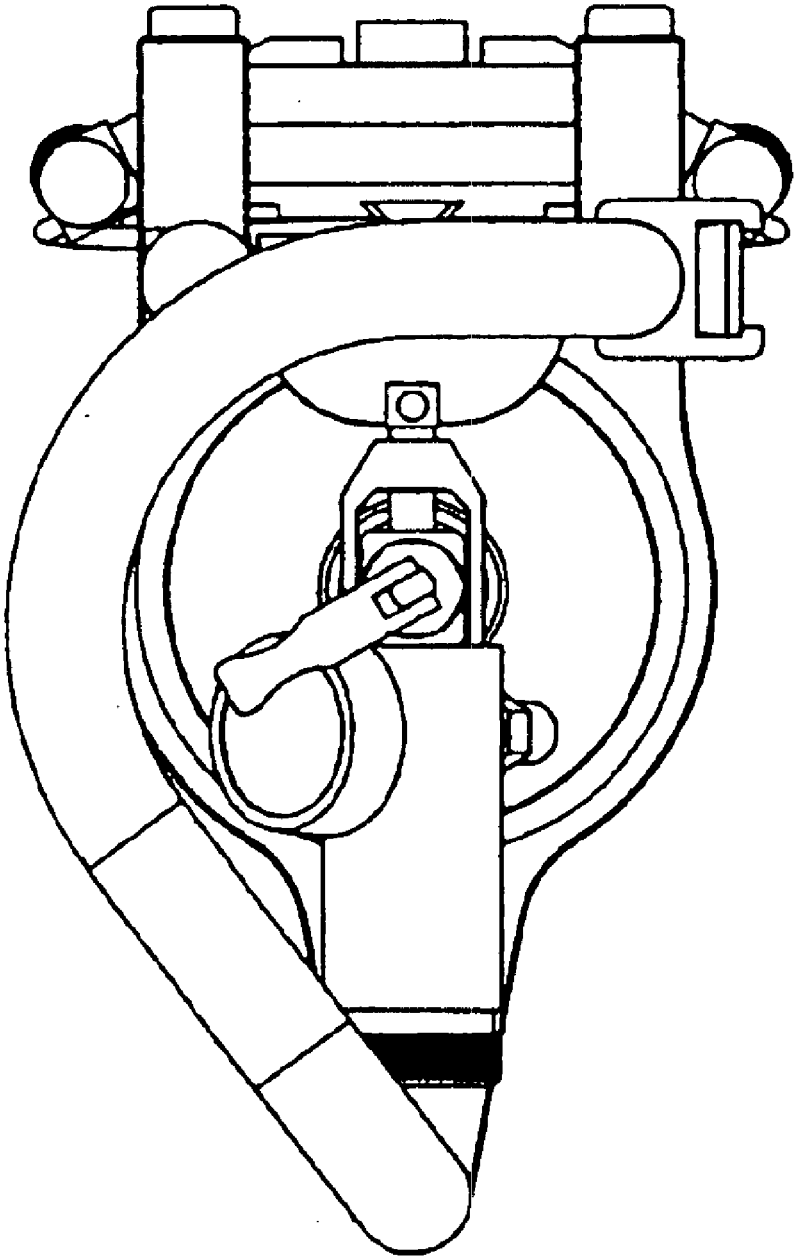
FIG. 9 is, in plan view, the canister retaining frame of FIG. 6.

Some alternative embodiments, not intended to be limiting, of the apparatus for releasing upper pin 56*a* from engagement with pawl 22 are illustrated in FIGS. 5, 5*a* and 5*b* and in FIGS. 13–19. For example in FIG. 5, release levers 76 are mounted to the ends of spindle 24 so as to extend outwardly of cover plate 36. Rotation of release levers 76 in direction C correspondingly rotate both spindle 24 in direction B and pawl 22 so as to release pin 56*a* from engagement in cavity 22*b* behind pawl flange 22*a*. Other embodiments are discussed further below.

Figure 1:
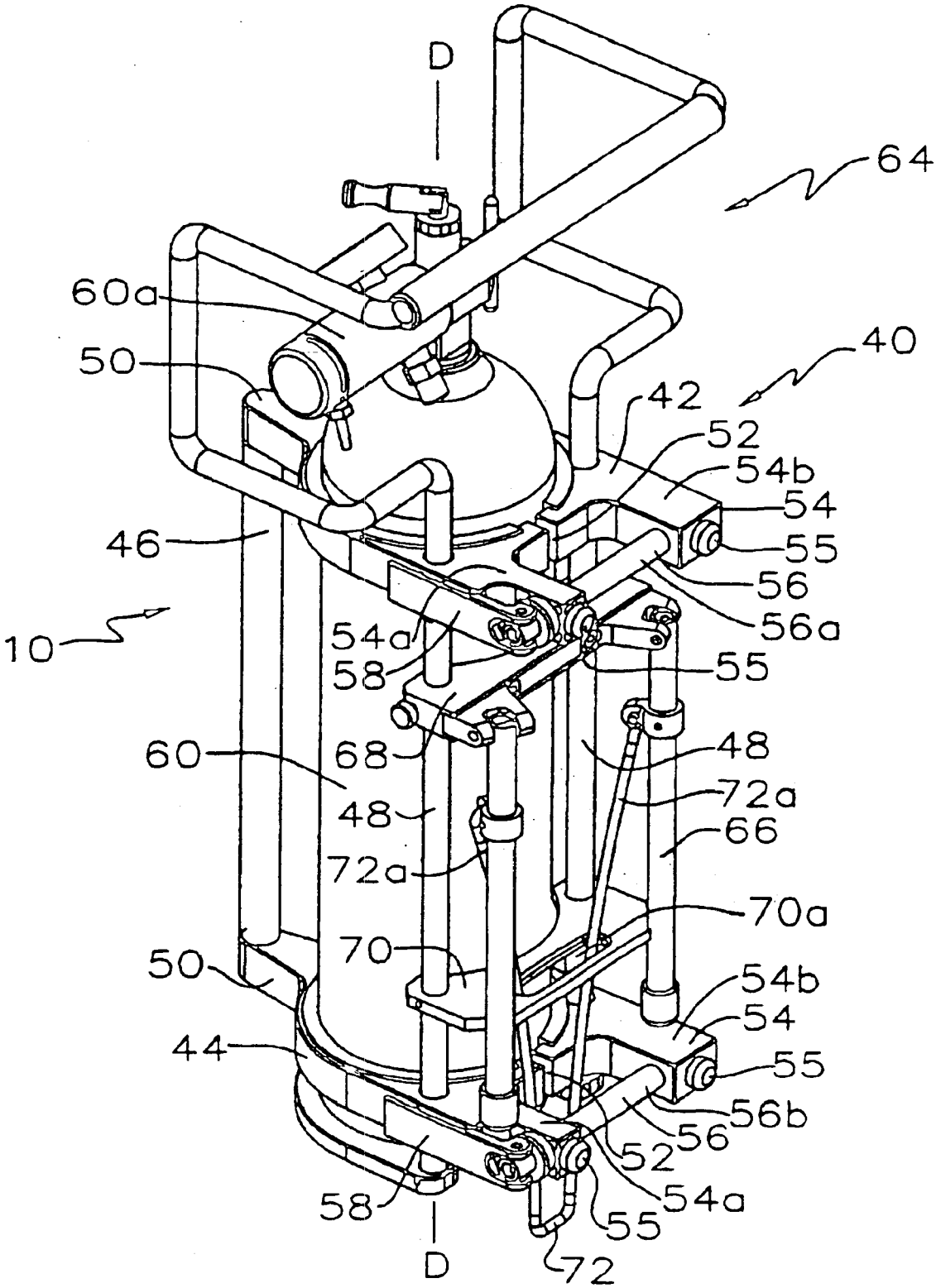
FIG. 1 is an isometric view of the retaining, carrying and supporting apparatus of the present invention.

As seen in FIGS. 6–10, the canister retaining frame and gas flow regulator guard 64 which protects for example regulator 60*a* on cylinder 60 is, without intending to be limiting, modified from that discussed above and illustrated in FIG. 1. Thus, as may be seen, the rectangular gas flow regulator guard 64 of FIGS. 1–3 is modified in the embodiment of FIGS. 6–10 into the single arcuate loop of gas flow regulator guard 64'. Guard 64' extends from the upper end of handle 46 above protrusion 50 so as to extend initially parallel to handle 46 so as to clear regulator 60*a*, and then curves over and around the regulator and its associated components and around the cross-sectional profile of the tank, cylinder or canister 60 so as to loop down onto, and to be mounted to the end of, one side of collar 42'. Collar 42' is mounted snugly annularly around the regulator end of cylinder 60. The lower or opposite end of cylinder 60 is mounted snugly within collar 44', collar 44' supporting on protrusion 50' the end of handle 46 opposite to gas flow regulator guard 64'.

Figure 10:
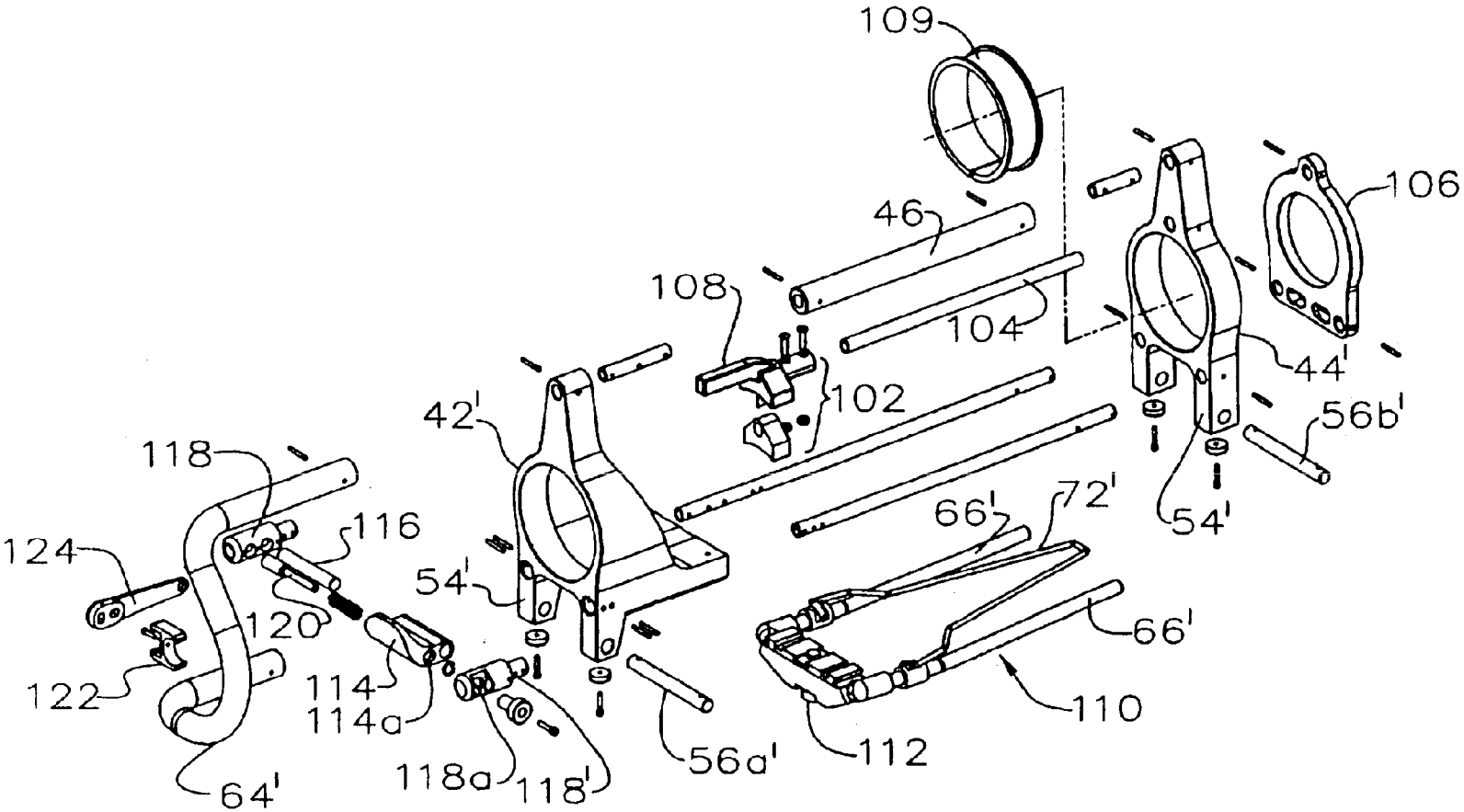
FIG. 10 is, in exploded view, the canister retaining frame of FIG. 6.

In this embodiment, collars 42' and 44' may assist in preventing rotation of cylinder 60 relative to the handle and gas flow regulator guard by the snug mounting of cylinder 60 within the collars. However, because of non-uniform diameters of cylinder 60 for example as between D and E size steel or aluminium tanks, an auxiliary rotation restraining device may be provided, such as exemplary device 100. One such device, as illustrated, relies on a friction pad 102 which is resiliently urged against the side of cylinder 60 by the bending moment applied by a bar or shaft 104 cantilevered upwardly from its rigid mounting in the base of protrusion 50' where the protrusion intersects collar 44'. Shaft 104 is, in the embodiment illustrated, journalled through a hole in the base of protrusion 50' so as to extend into contact with, and is rigidly mounted to, a base plate 106 mounted parallel to and underneath collar 44'. The thickness of friction pad 102 when engaged against the side of cylinder 60, may slightly deflect or bend shaft 104 so that friction pad 102 exerts a force against the side of cylinder 60 sufficient that the friction between the two surfaces resists the rotation of cylinder 60 about its longitudinal axis D. This then maintains the orientation of, for example, regulator 60*a* protected underneath the protective penumbra afforded by gas flow regulator guard 64'. A handle 108 may be mounted to friction pad 102 or, for example, the end of shaft 104 so that an operator may pull on handle 108 to urge handle 108 and friction pad 102 towards handle 46 thereby releasing the frictional engagement of the friction pad against the cylinder. This allows the cylinder to be changed or reoriented as necessary. Because of the variation in the marketplace between cylinder diameters, in order to provide a snug fit of the collars around the canister, spacing sleeves 109, as seen in FIG. 10, may be provided for fitment between the collars and canister. The sleeves would be of sufficient thickness so as to provide a snug fit.

A pair of spacing tubes 48' are rigidly mounted in parallel spaced apart array between collars 42' and 44' so as to rigidly support the collars. The collars are thus supported spaced apart from one another by handle 46 and tubes 48'. The length of handle 46 and tubes 48' are such that cylinders of different length, for example D and E sizes, may be accommodated. Again, an automatically deploying bi-pod leg assembly, for example modified by shortening from a commercially available golf bag tripod leg assembly such as manufactured by Exim Golf of New York, N.Y., may be employed. Thus, as before, with the assembly adjusted relative to collar 42', and releasably mounted thereto for example by means of bolt 112 engaging one of an array of bolt holes (not shown) on the back of collar 42', placing base plate 106 onto the ground drives the connecting rod structure 72' upwardly relative to the base plate so as to deploy the tripod legs 66' outwardly of the retaining frame into their deployed position as in FIG. 2. By use of the releasable mounting provided for example by means of bolt 112, bi-pod leg assembly 110 may be remounted higher up along the back of collar 42' so as to disengage the bottom of rods 72' from touching the ground when base plate 106 is resting on the ground. In this way, the deploying of legs 66' is disabled.

A releasable slide-inhibiting arm 114 may be mounted at the upper end of collar 42'. Arm 114 is pivotable on pin 116 between supporting posts 118 so as to be rotatable between an open position allowing extraction of cylinder 60 from its journalled mounting in collars 42' and 44', and a closed position where the curved end of the arm may be rotated over the end of cylinder 60 so as to restrain movement of cylinder 60 along its longitudinal axis relative to collars 42' and 44'. Arm 114 may be releasably lockable into its closed position retaining the cylinder and preventing longitudinal sliding within the collars for example by means of a spring-loaded pin or bolt 120 arrangement between posts 118 and 118' so as to restrain the pivoting rotation of latch arm 114 about pin 116 by journalling of pin 120 through hole 114*a* so as to releasably lock into mating engagement with a corresponding hole 118*a* on post 118'.

A tank valve wrench holder 122 may be mounted to one side of gas flow regulator guard 64' so as to provide a convenient storage and holding location for a tank valve wrench 124.

As before, upper and lower pins 56*a'* and 56*b'* are mounted in supporting yokes 54' in collars 42' and 44' respectively. The yokes may have rubber fee 55 for supporting frame 40 when laid down. Pin 56*b'* as before mates with supporting arm 12*b*, which as shown may also be a parallel pair of hooked flanges, and pin 56*a'* mates into latch receiving arm 12*c*, which also may be a parallel pair of flanges, of mounting bracket 12 so as to releasably mount retaining frame 40 and canister 60 for convenient storage, transportation and use.

Figure 11:
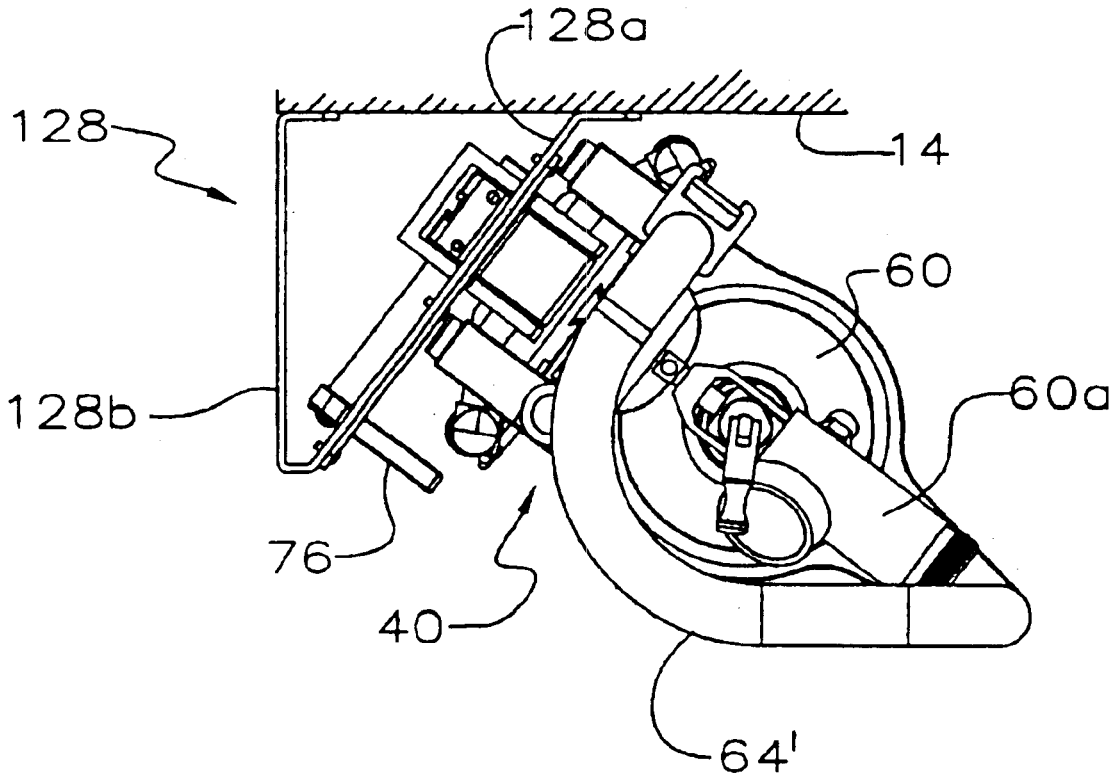
FIG. 11 is, the canister retaining frame of FIG. 6 mounted to an angled supporting bracket using an alternative embodiment of the mounting bracket of FIG. 5*a*.
Figure 12:
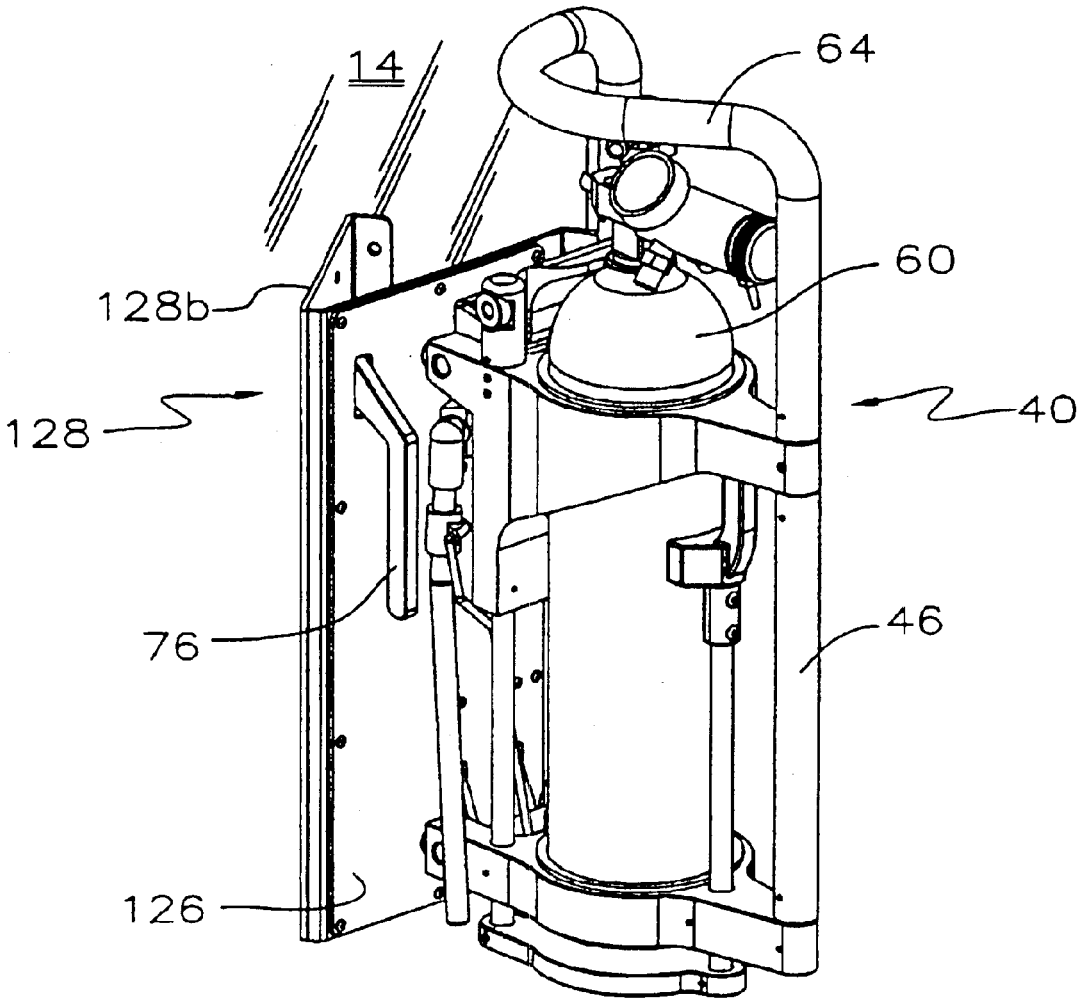
FIG. 12 is, in perspective view, the canister retaining frame mounted to an angled supporting bracket of FIG. 11.
Figure 13:
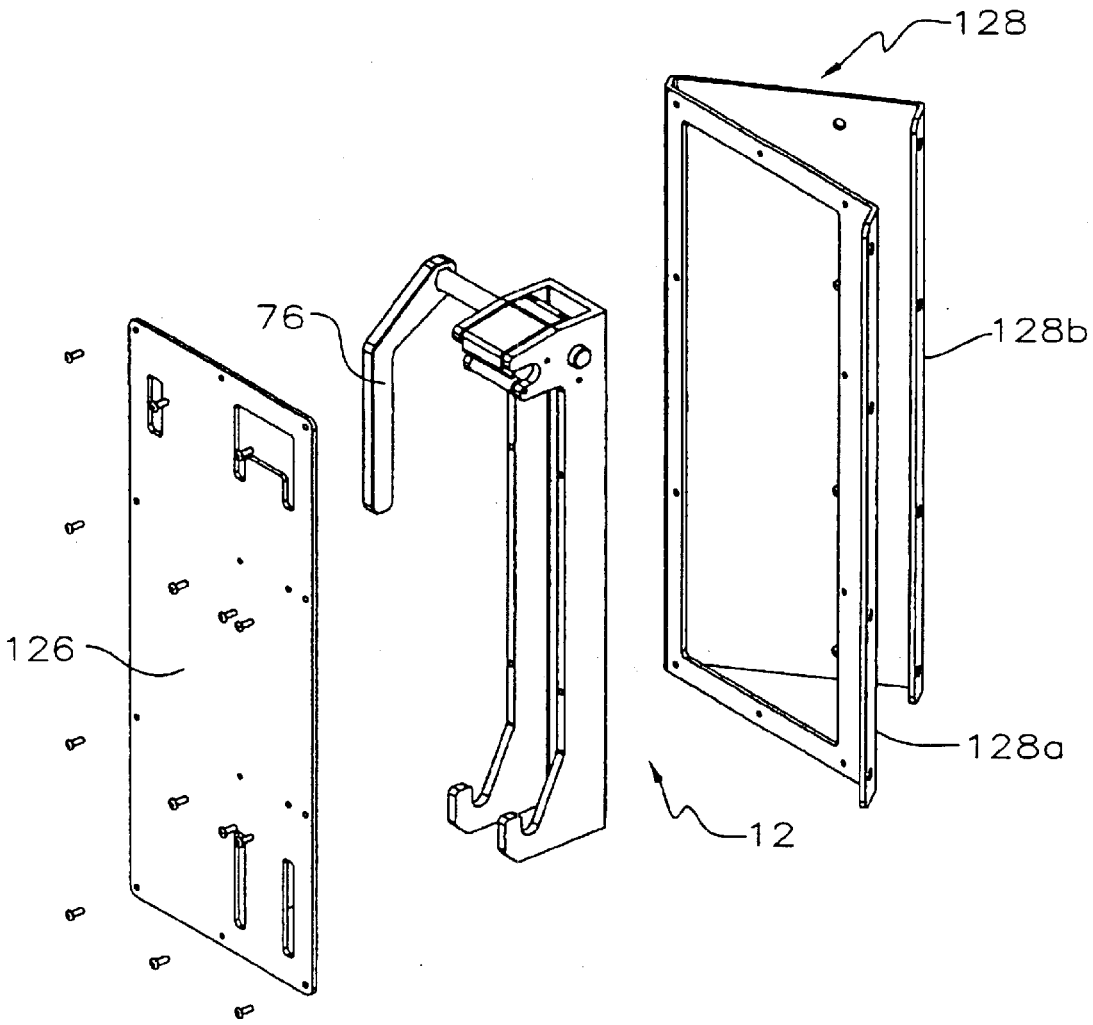
FIG. 13 is, in exploded view, the angled supporting bracket and mounting bracket of FIG. 11.

In a further embodiment of the mounting brackets of FIGS. 4, 5 and 5*a*, and again without intending to be limiting, the mounting bracket 12 of FIG. 5*b* is mounted behind a plate 126 in the wedge-shaped cavity defined by the front supporting frame 128 and the backing plate 128*b* of angled supporting bracket 128. Thus as seen in FIGS. 11 and 12, a retaining frame 40 and canister 60 such as described in relation to FIGS. 6–10, may be mounted to mounting bracket 12, when mounting bracket 12 is mounted within angled supporting bracket 128, so that the canister and retaining frame combination is angled or inclined towards and along inside surface 14. Thus retaining frame 40 and canister 60 are less intrusive into the working space within, for example, the back of an emergency vehicle, and may for example provide for ease of retrieving the canister through the open door of the emergency vehicle. The release mechanism used to release retaining frame 40 from mounting in mounting bracket 12 may be similar to the release mechanism of FIG. 5*b* with the exception that only one release handle 76 is provided because the mounting of retaining frame 40 and canister 60 inclined towards inside surface 14 blocks access to one side of mounting bracket 12. The use of curved handle 64' eases grasping of the canister and retaining frame from any angle about the longitudinal axis of the canister, and thus inclining the retaining frame using bracket 128 does not necessarily adversely impact ease of manipulation of the retaining frame from inside the vehicle.

Figure 14:
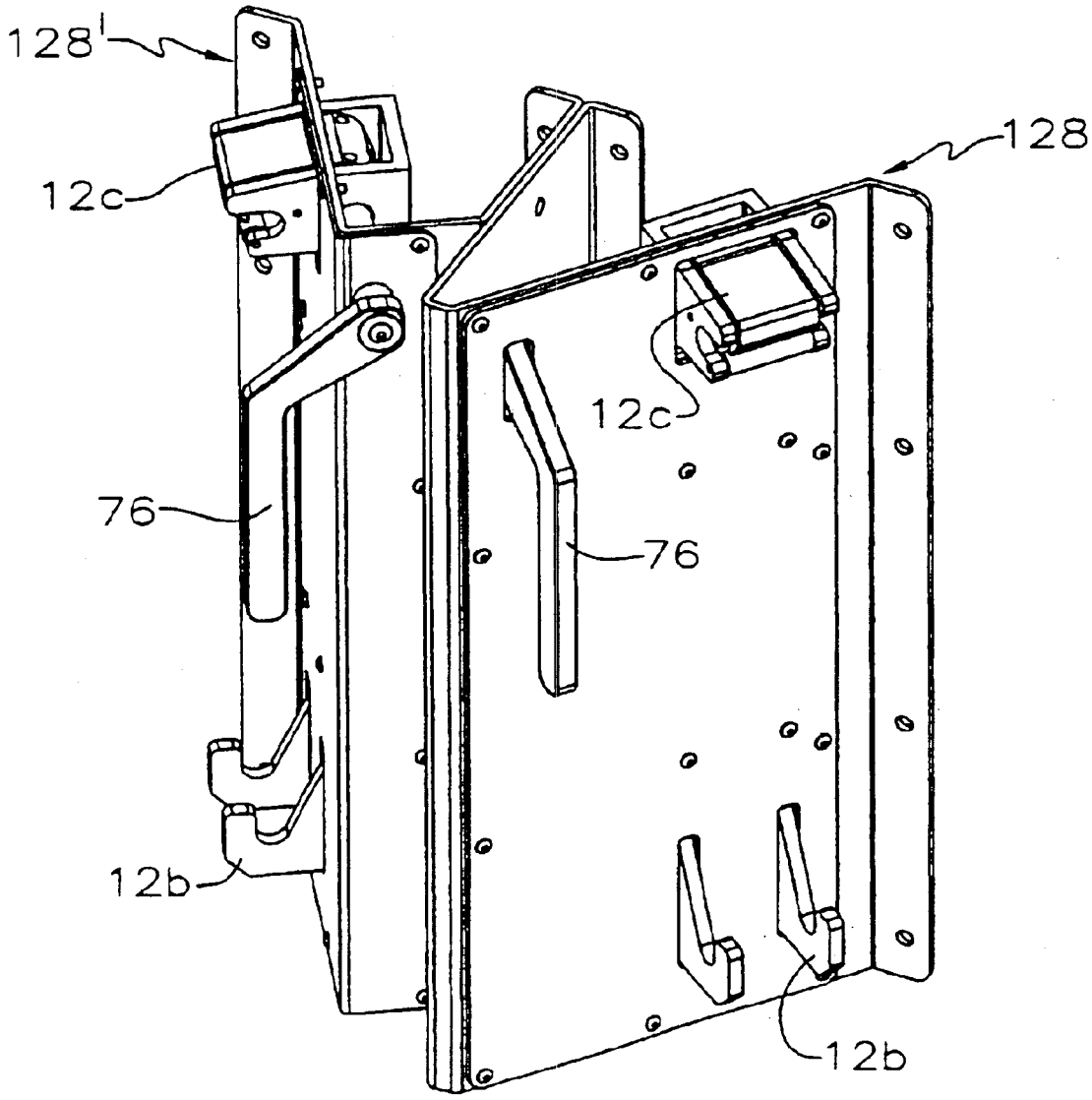
FIG. 14 is, in perspective view, a pair of back-to-back angled supporting brackets and their corresponding canister retaining frame mounting brackets.
Figure 15:
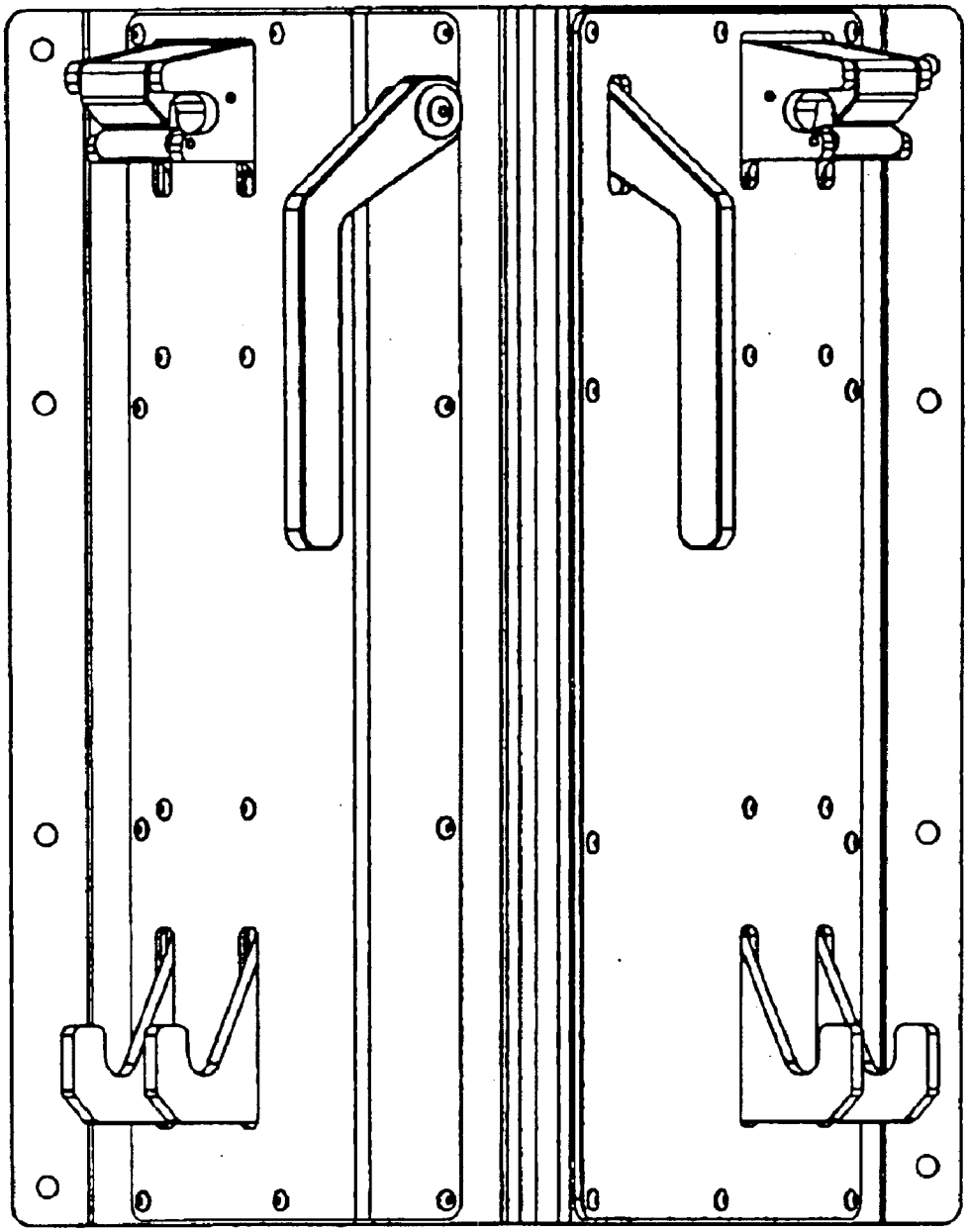
FIG. 15 is, in front elevation view, the pair of back-to-back angled supporting brackets of FIG. 14.
Figure 16:
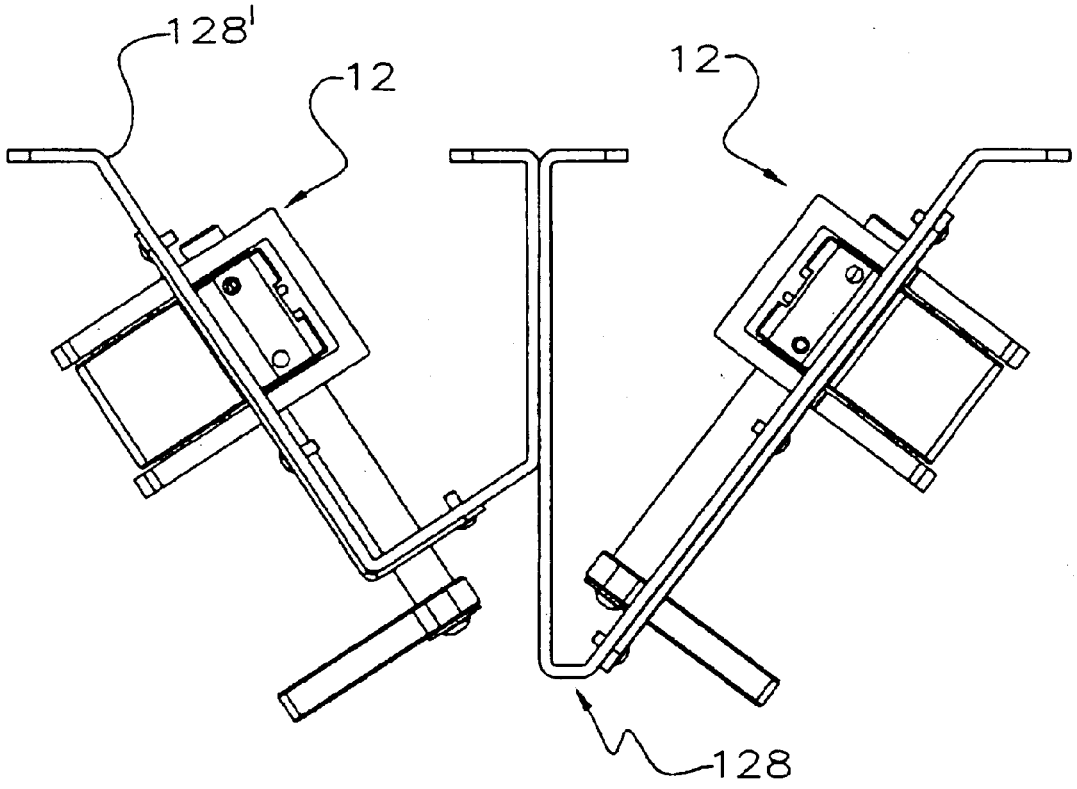
FIG. 16 is, in plan view the angled supporting brackets of FIG. 15.

As seen in FIGS. 14–16, angled supporting brackets 128 may be slightly modified so as to be used modularly as for example in the back-to-back paired mounting of supporting bracket 128 and modified supporting bracket 128', modified to allow the protrusion of handle 76 from the side of a corresponding mounting bracket 12. Brackets 128 are also reversible, to accommodate left or right handed access, by inverting brackets 128 and reversing their face plates.

Figure 17:
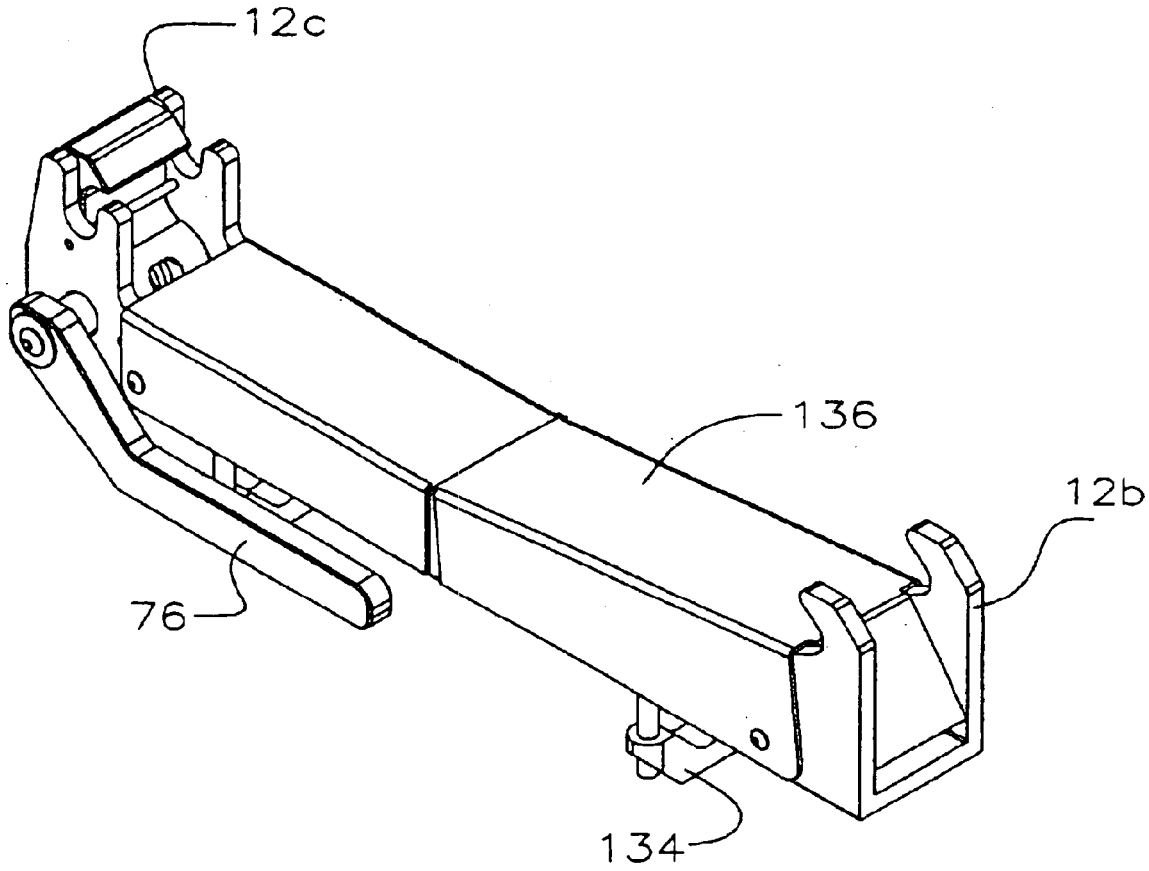
FIG. 17 is, in perspective view, an alternative embodiment of the mounting bracket of FIG. 13 adapted for mounting to a stretcher frame member.
Figure 18:
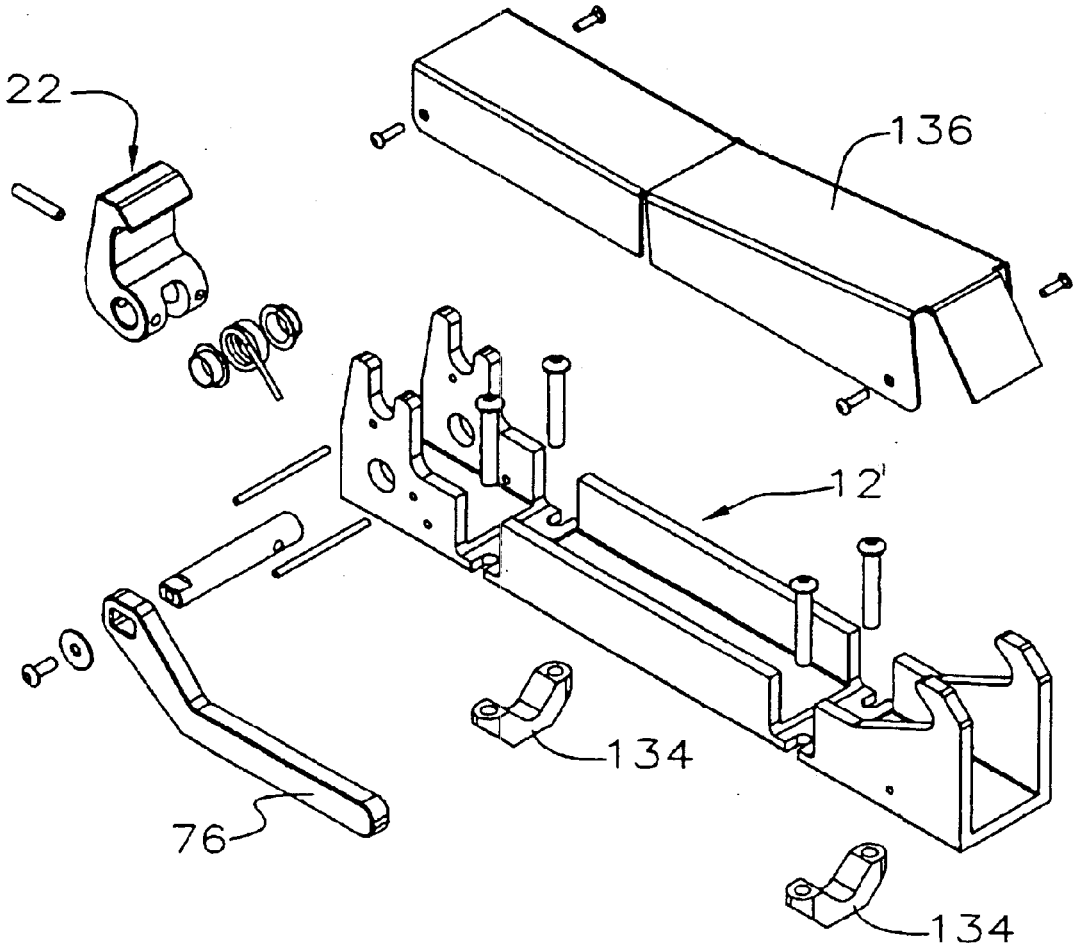
FIG. 18 is, in exploded view, the mounting bracket of FIG. 17.
Figure 19:
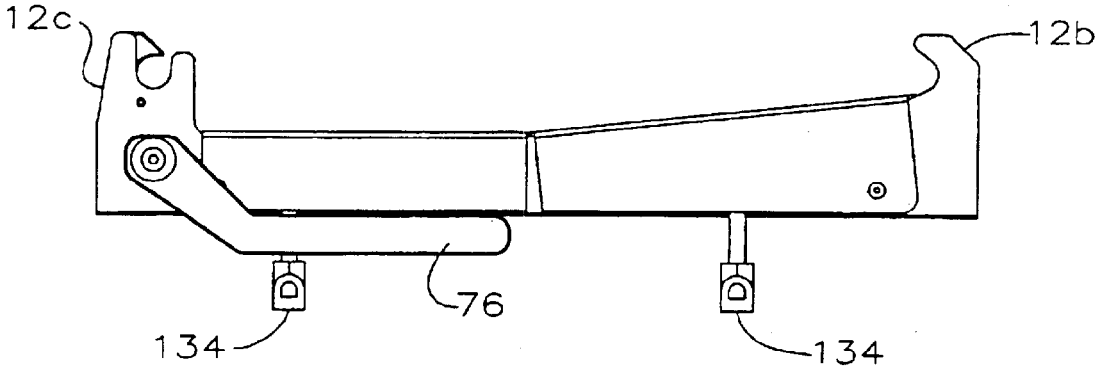
FIG. 19 is, in side elevation view, the mounting bracket of FIG. 17.
Figure 20:
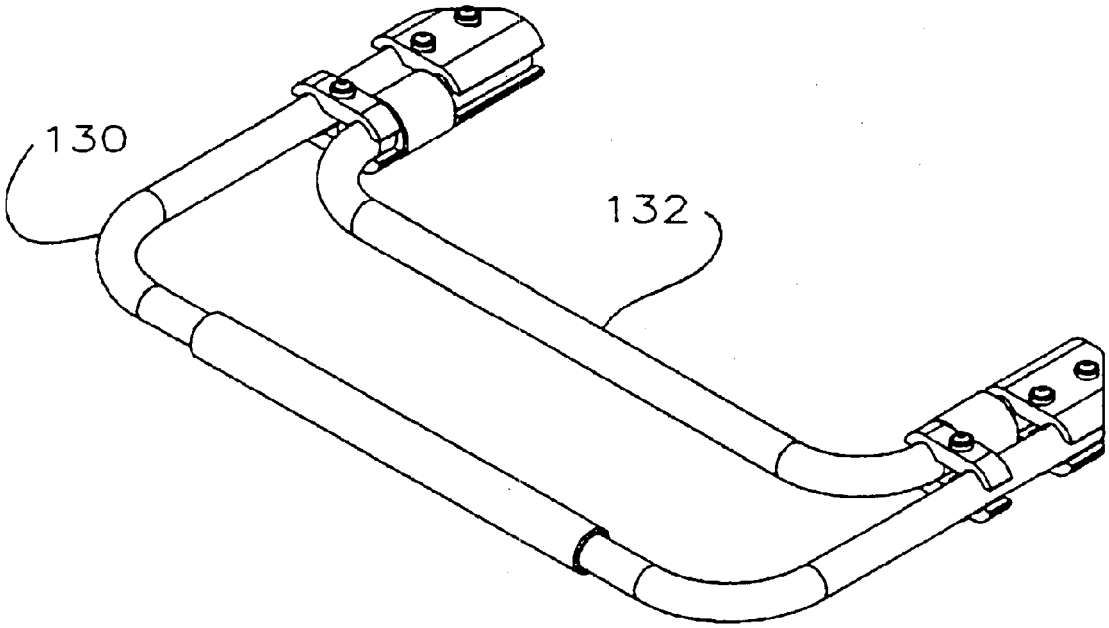
FIG. 20 is, in perspective view, a stretcher frame extension member mounted to one end of a stretcher frame.

As seen in FIGS. 17–19, mounting bracket 12 may be adapted for mounting to a tubular member rather than a planar supporting surface, where such a tubular member may be a frame member of a stretcher. For example, the tubular member may be the "U" shaped stretcher frame extension 130 such as seen in FIG. 20 mounted to one end of a conventional stretcher tube frame 132. As better seen in FIG. 18, mounting bracket 12' again supports handle 76 operatively connected to pawl 22 so as to release retaining frame 40 from its mating with mounting bracket 12'. The back side of mounting bracket 12' is mounted on to a member such as extension 130 by the use of, for example, a pair of "U" shaped couplers 134 mountable to the back of mounting plate 12' so as to clamp a length of extension 130 between the couplers and the mounting bracket. Thus, by way of example, with extension 130 mounted to the head of an existing stretcher frame, and with mounting bracket 12' mounted along extension 130 so as to parallel the head of the stretcher, a retaining frame 40 and canister 60 may be quickly and releasably mounted on to the stretcher extension 130 for ease of supplying an on-going supply of gas to a patient on the stretcher. In the example of FIGS. 17–19, mounting bracket 12' is enclosed within a housing 136 along its length.

Figure 21:
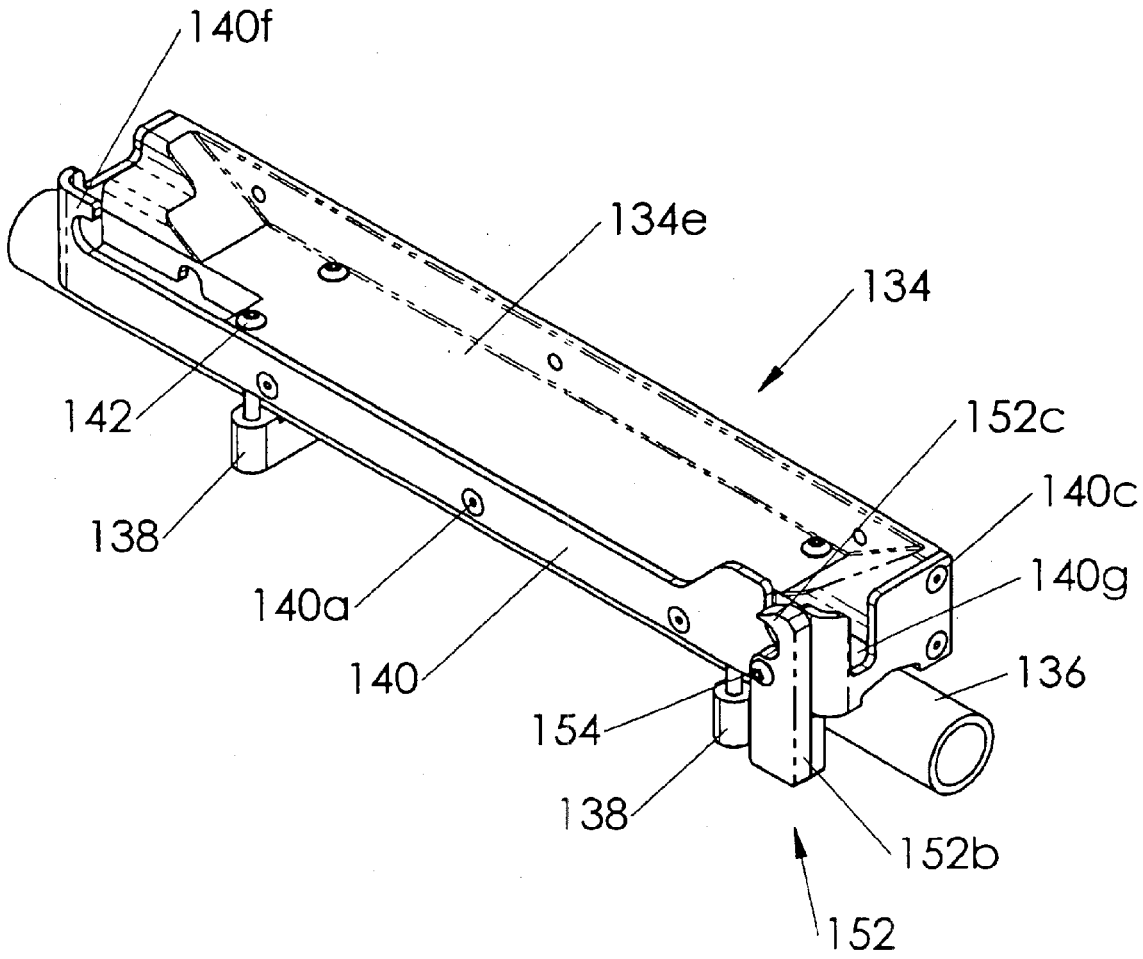
FIG. 21 is, in perspective view, an alternative embodiment of the mounting brackets shown in FIGS. 13 and 17, mounted to a tubular stretcher frame member.
Figure 22:
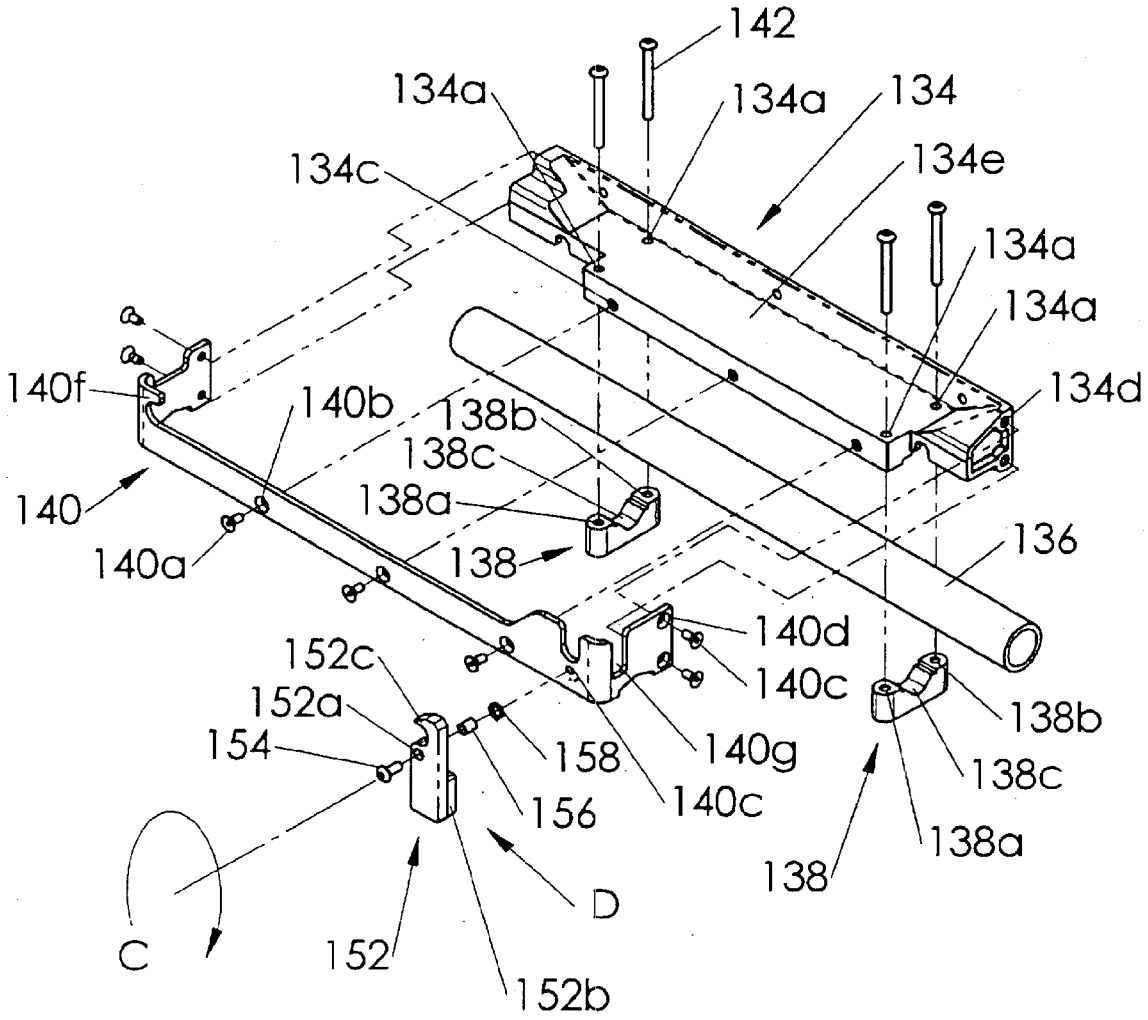
FIG. 22 is, in exploded view, the mounting bracket of FIG. 21.

In a further embodiment as seen in FIGS. 21 and 22, a mounting bracket 134 is adapted for mounting to a rigid support member of a medical patient transporter such as tubular stretcher frame member 136. For example, tubular stretcher frame member 136 may be the side rail of a Ferno stretcher. As seen in the exploded view of FIG. 22, mounting bracket 134 is clamped onto tubular member 136 by a plurality of collars 138 which are mounted to bracket 134 by a corresponding plurality of screws 142. Screws 142 are journalled through a plurality of apertures 134*a* on upper surface 134*e* of bracket 134 and threadably engage apertures 138*a* and 138*b* in the collars, seen in FIG. 22, so as to form a tight seal around tubular stretcher member 136. Collars 138 have a channel, cavity or recess (collectively herein called a channel) 138*c* formed on their upper surface. The internal curvature of the channel, in cross section, matches the curvature of the outside surface of tubular member 136 for conformal mating of collars 138 thereon. Collars 138 and bracket 134 are clamped tightly around tubular member 136 such that bracket 134 is rigidly mounted in place, and so as to prevent slipping rotation of bracket 134 around tubular member 136.

To facilitate the mounting of retaining frame 40 and canister 60 to bracket 134, adapter plate 140 is fastened to bracket 134 by one or more short bolts or screws such as bolts 140*a* and 140*c* which are journalled through corresponding apertures, such as apertures 140*b* and 140*d*, in plate 140 so as to threadably engage corresponding threaded apertures, such as 134*c* and 134*d* in mounting bracket 134.

Latch arm 152 is pivotally mounted to plate 140 by screw 154 which is snugly journalled in sequence through aperture 152*a* in latch arm 152, shaft 156, coil spring 158 and aperture 140*e* in plate 140. Shaft 156 is journalled through spring 158 so that latch arm 152 is rotatable against the return biasing force of spring 158 which rotatably urges the latch arm into the closed position as shown in FIG. 21.

Figure 27:
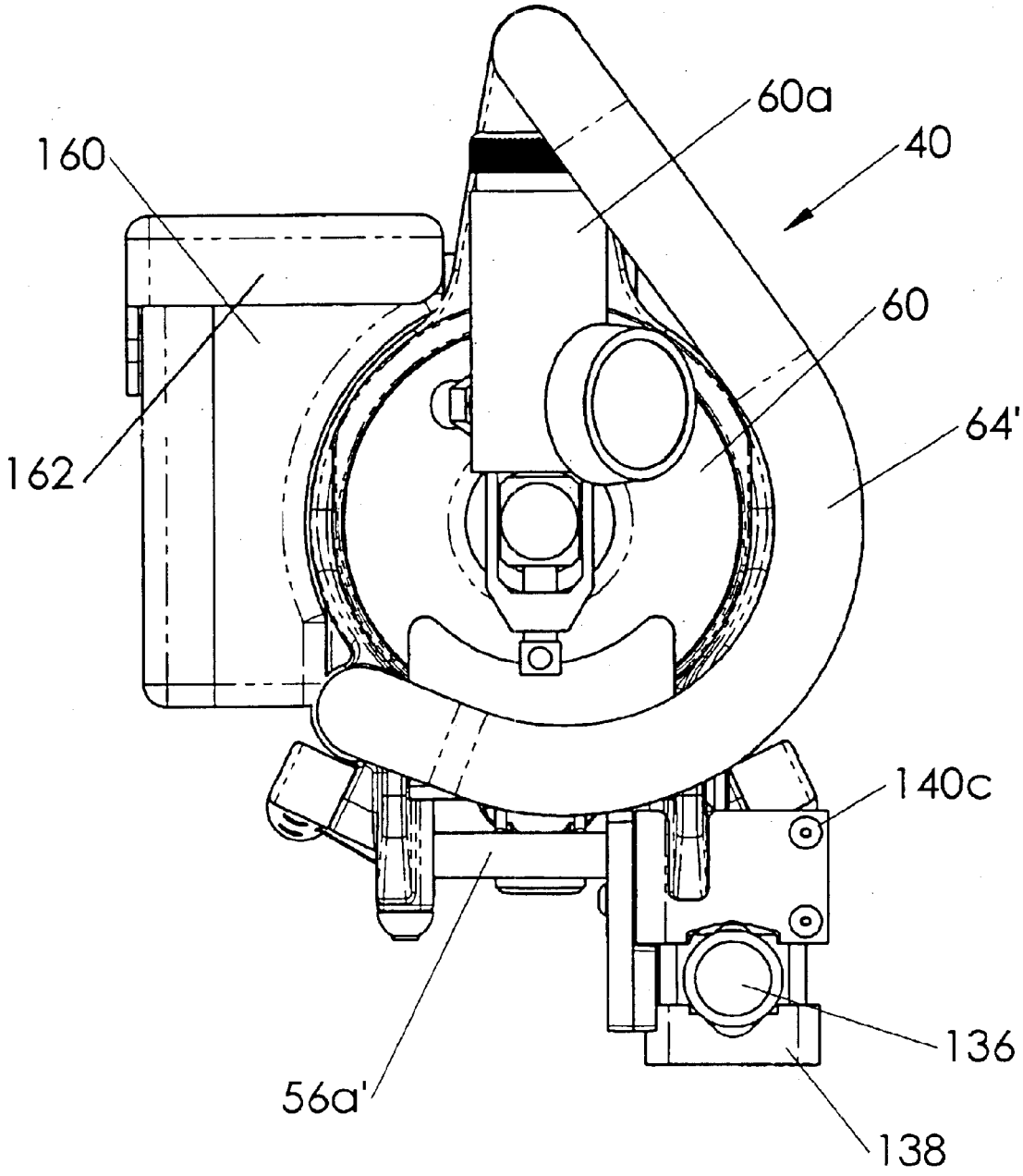
FIG. 27 is, in end elevation view, the mounted canister retaining frame and attached storage container mounted to the mounting bracket of FIG. 21.
Figure 31:
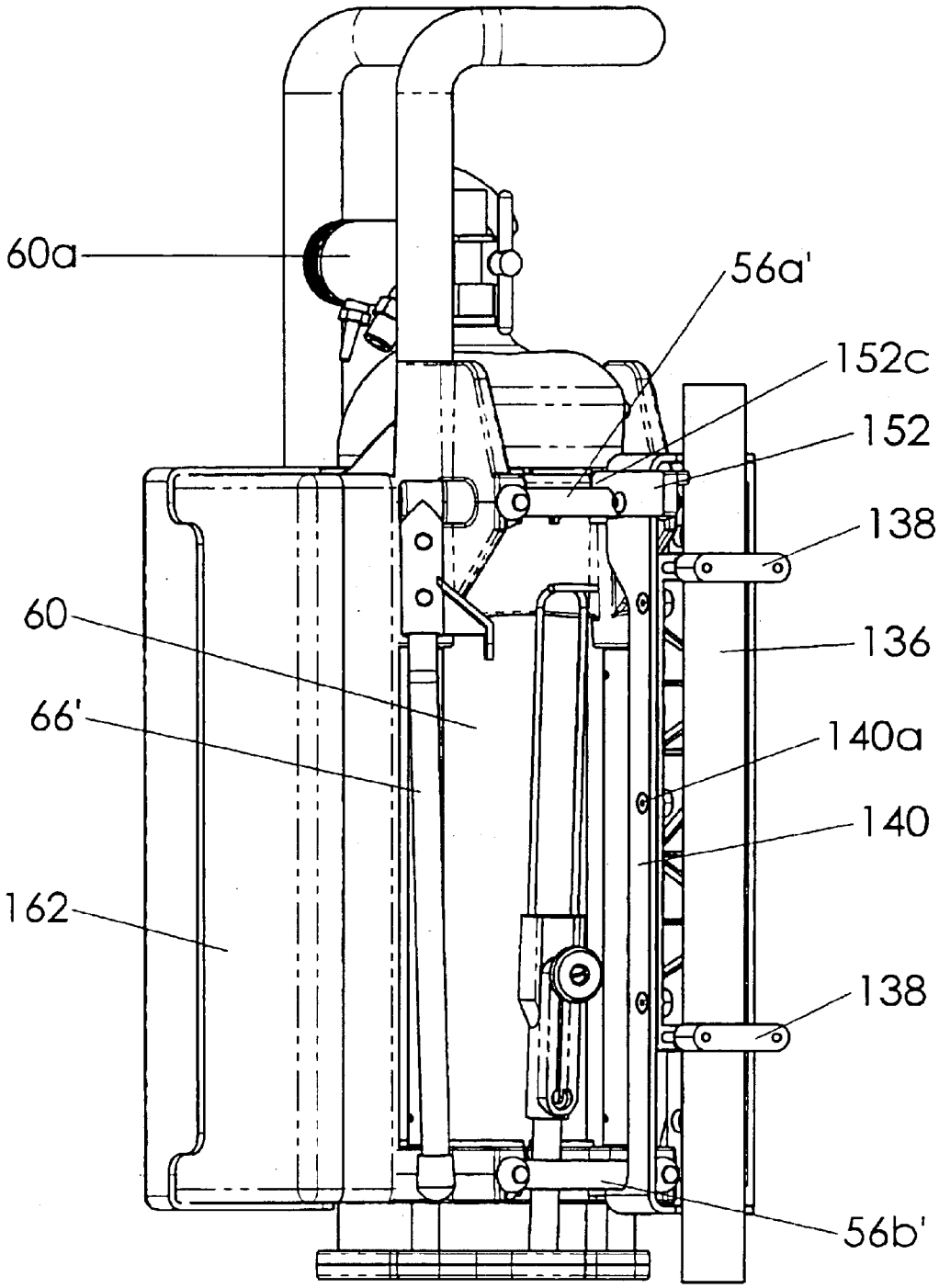
FIG. 31 is an isometric view of the mounted canister retaining frame mounted to the mounting bracket of FIG. 21.

Retaining frame 40 and canister 60, when held within retaining frame 40, may be releasably mounted onto mounting bracket 134. With retaining pin 56*b*' on frame 40 hooked under fixed hook 140*f* on plate 140, pin 56*a*' on frame 40, best seen in FIG. 31, is aligned so as to engage latch arm 152. With pin 56*b*' under hook 140*f*, frame 40 is urged against bracket 134 so as to push pin 56*a*' against latch arm 152. Latch arm 152 rotates in direction C against the return biasing face of spring 158. Pin 56*a*' may then be inserted into and rest in groove 140*g* in plate 140 so that, when latch arm 152 resiliently rotates back to its closed position, pin 56*a*' is held under latch hook 152*c* on the end of latch arm 152, latch arm 152 thereby releasably holding retaining frame 40 and canister 60 fixed in place on mounting bracket 134 as seen in FIGS. 27 and 31.

The upper surface 134*e* of mounting bracket 134 may be tapered or shaped so as to mate with the tapering or shape of retaining frame 40 and canister 60. When force is applied in direction D (seen in FIG. 22) against latch arm release actuator 152*b*, latch arm 152 rotates in direction C thereby releasing pin 56*a*' from under latch hook 152*c*. Retaining frame 40 may then be removed from mounting bracket 134 by unhooking pin 56*b*' from under fixed hook 140*f* on plate 140.

Figure 28:
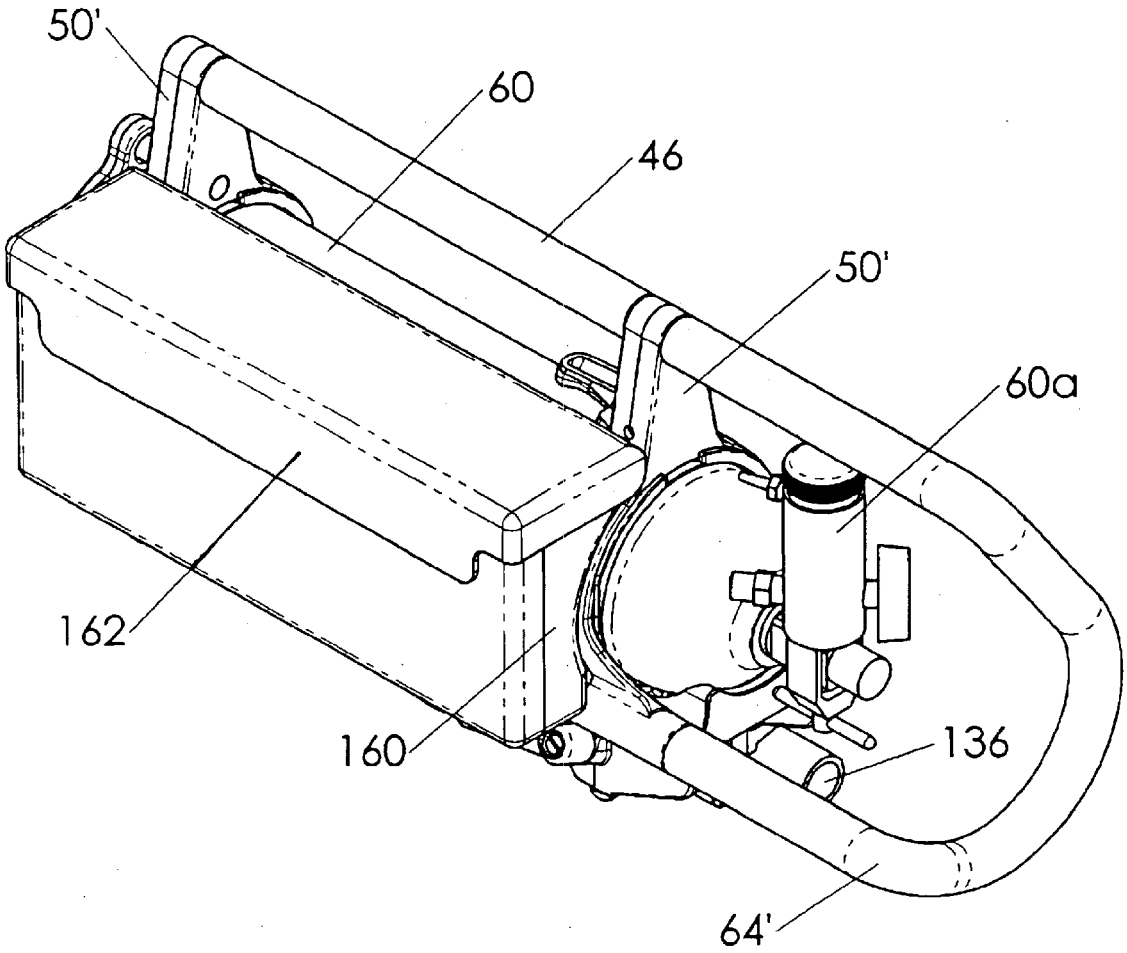
FIG. 28 is, in perspective view, the mounted canister retaining frame of FIG. 27 with a storage container attached.
Figure 29:
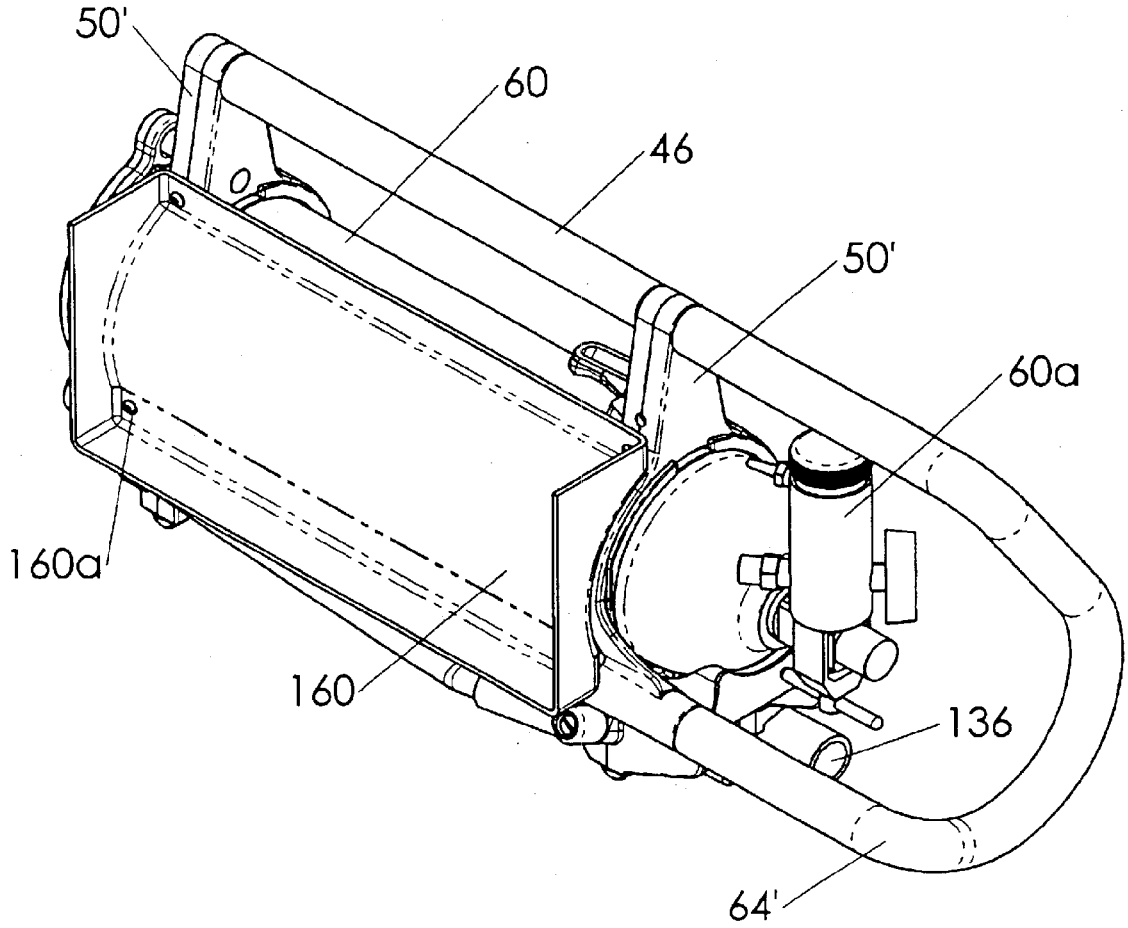
FIG. 29 is, in perspective view, the mounted canister retaining frame and attached storage container of FIG. 28 with the cover to the storage container removed.
Figure 30:
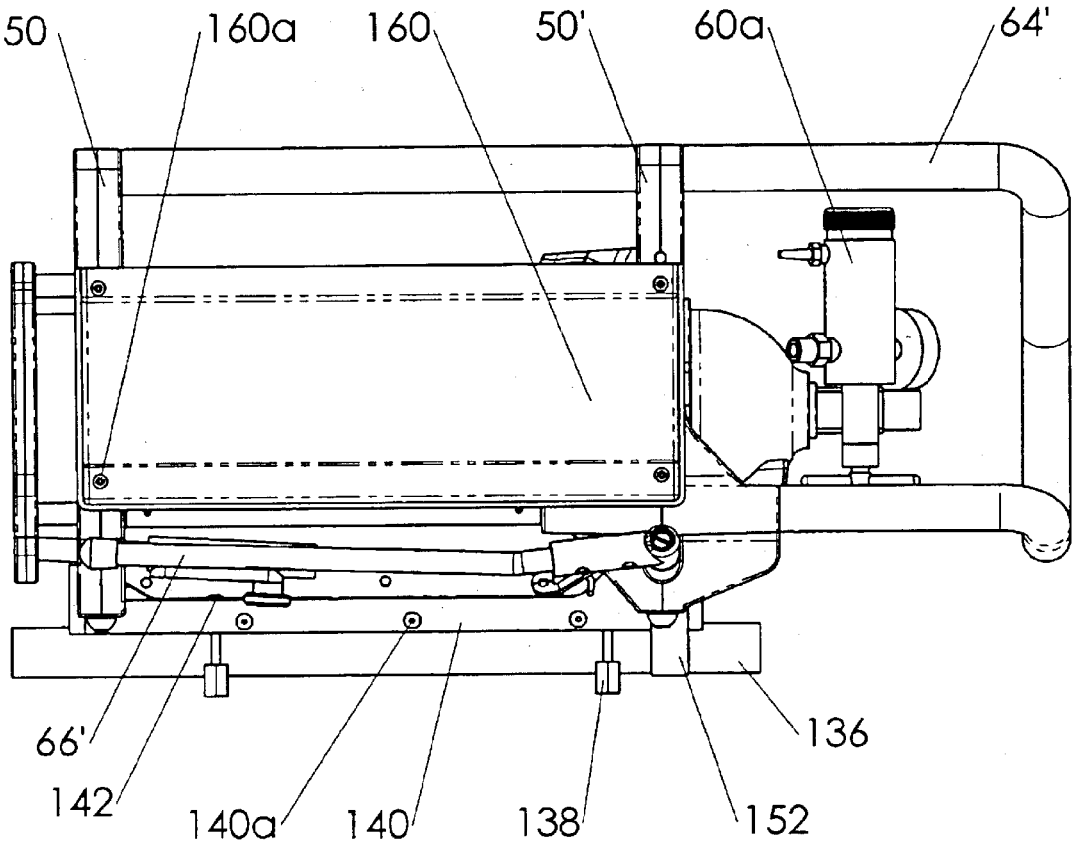
FIG. 30 is, in side elevation view, the mounted canister retaining frame and attached storage container of FIG. 29.

As seen in FIGS. 28, 29 and 30, a storage container 160 may be attached to retaining frame 40 by a plurality of screws 160*a* which are journalled through the storage container and into corresponding apertures in retaining frame 40. In the embodiment seen in FIG. 28, not intended to be limiting, storage lid 162 mates with storage container 160 to form a tight seal and thereby provide a convenient storage and holding location for tools or supplies.

Figure 23:
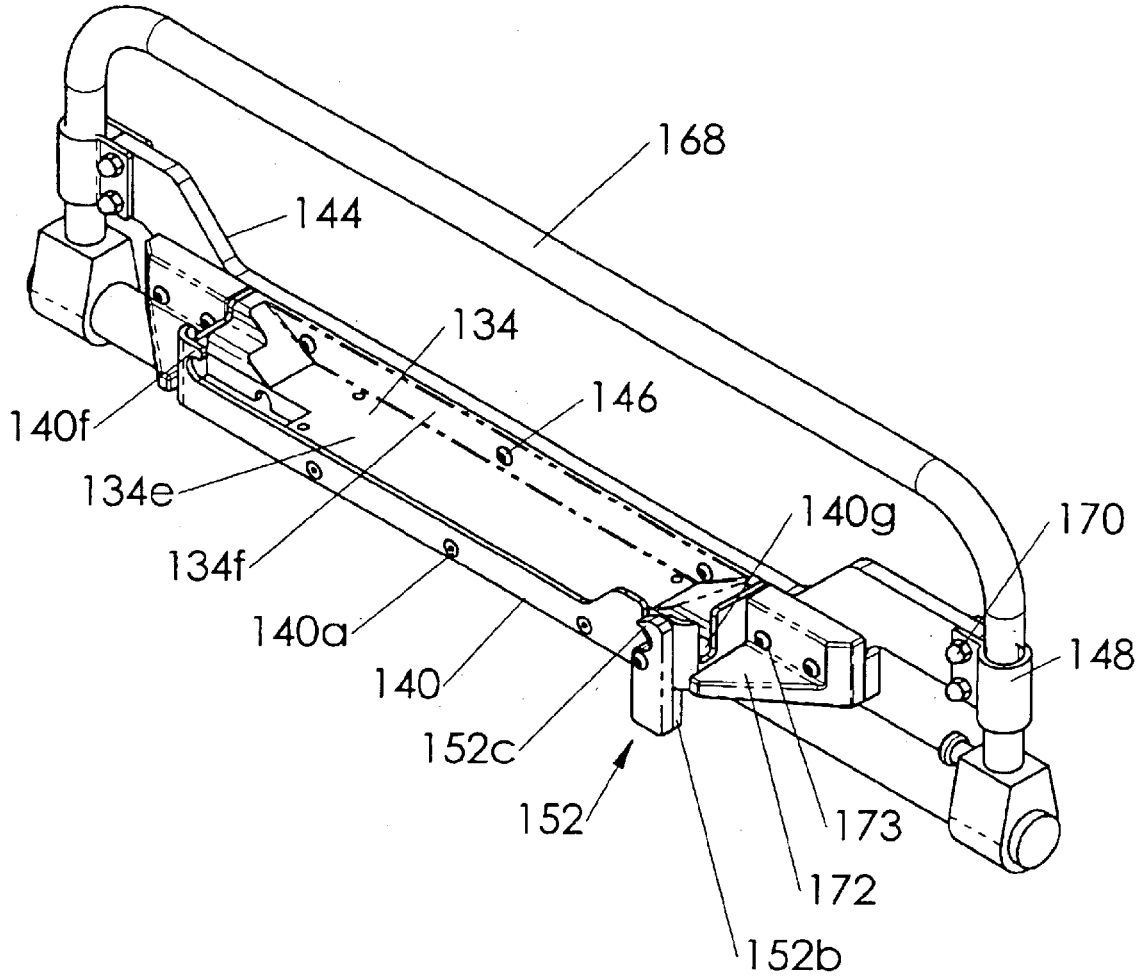
FIG. 23 is, in perspective view, an alternative embodiment of the mounting brackets shown in FIGS. 13, 17, and 21, mounted to the D-Bar of a stretcher frame.
Figure 24:
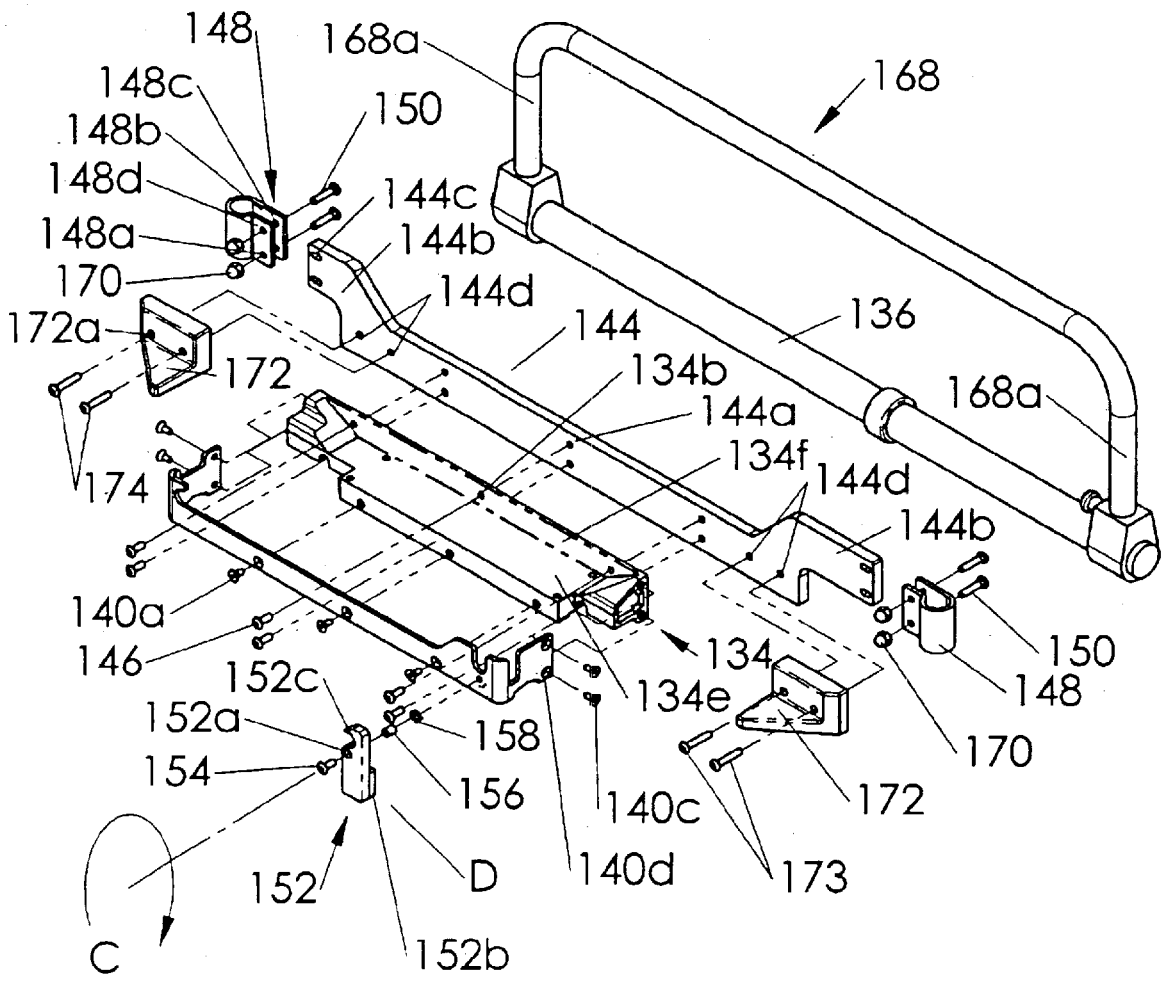
FIG. 24 is, in exploded view, the mounting bracket of FIG. 23.

In a further embodiment of the invention incorporating the latch mechanism described above and illustrated in FIGS. 23 and 24, mounting bracket 134 is adapted for mounting to the D-Bar 168 of a Ferno stretcher. In this embodiment, mounting bracket 134 is fastened to elongated bar or member 144 by a plurality of bolts or screws, such as bolt 146, which are journalled through apertures in rear surface 134*f* of mounting bracket 134 both above (shown) and below (not shown) the level of upper surface 134, and threadably engage corresponding apertures, such as aperture 144*a*, in elongated member 144. Elongated member 144 is fastened to the uprights 168*a* at opposite ends of D-Bar 168 by collars 148, which encircle uprights 168*a* and for each D-Bar 168, oppose each other in the same plane. Extremities 144*b* of elongated member 144 are each inserted between protruding forward surface 148*a* and rearward surface 148*b* of collars 148. Bolts 150 are each journalled sequentially through apertures 148*c* in rearward surface 148*b* of collars 148, apertures 144*c* in member 144, and apertures 148*d* in forward surface 148*a* of collar 148 before threadably engaging nuts 170. Collars 148 thereby form a tight seal around uprights 168*a* and fix member 144 tightly in place between uprights 168*a* so that member 144 is coplanar with D-Bar 168, as seen in FIG. 23.

End pieces 172, which in one embodiment, not intended to be limiting, are resilient, for example made of rubber, and are mounted oppositely disposed abutting opposite ends of mounting bracket 134. Each end piece 172 may be fastened to bracket 134 by a plurality of bolts 173 which each pass through apertures, such as aperture 172*a*, in each end piece 172 before threadably engaging corresponding threaded apertures 144*d* in member 144.

Figure 25:
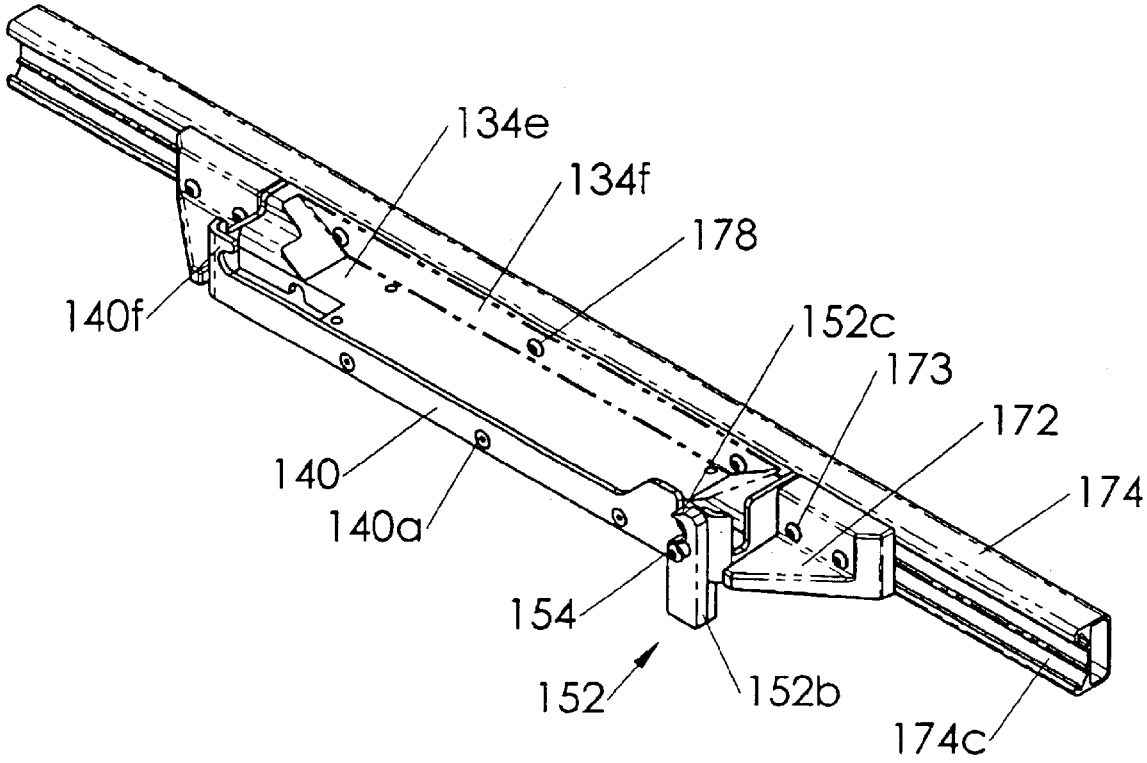
FIG. 25 is, in perspective view, an alternative embodiment of the mounting brackets shown in FIGS. 13, 17, 21 and 23, mounted to the side rail of a Stryker stretcher.
Figure 25A:
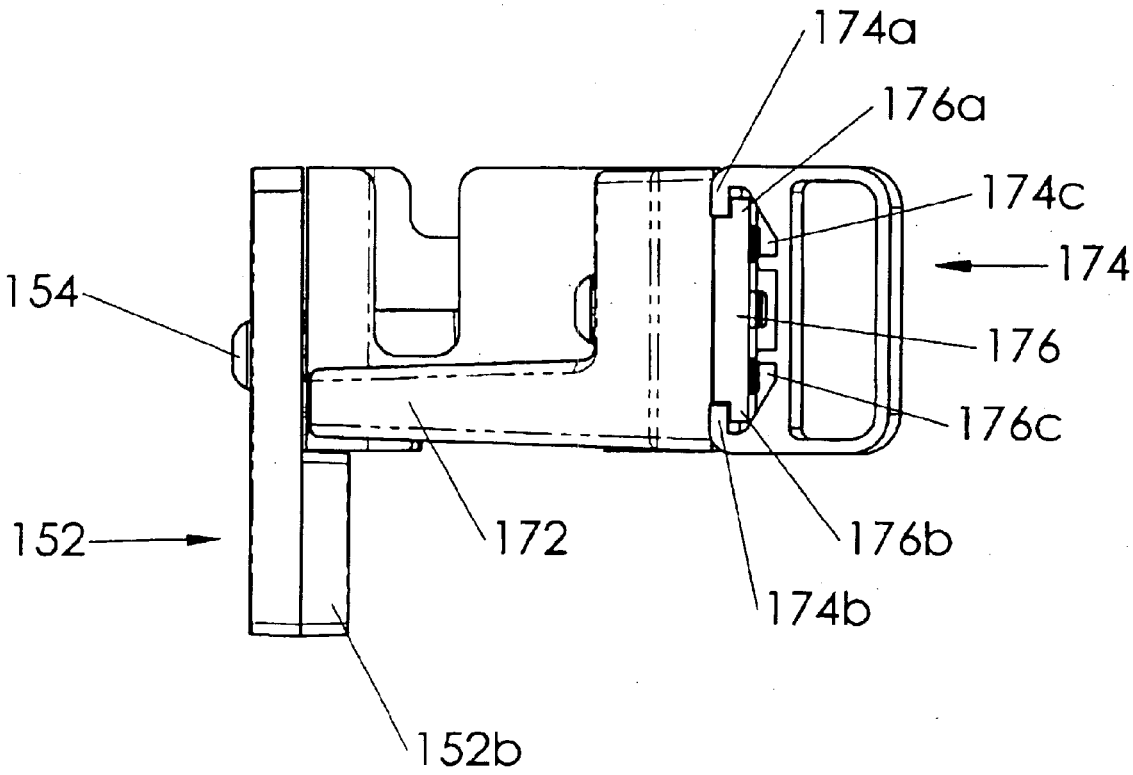
FIG. 25*a* is an end elevation view of the mounting bracket of FIG. 25.
Figure 26:
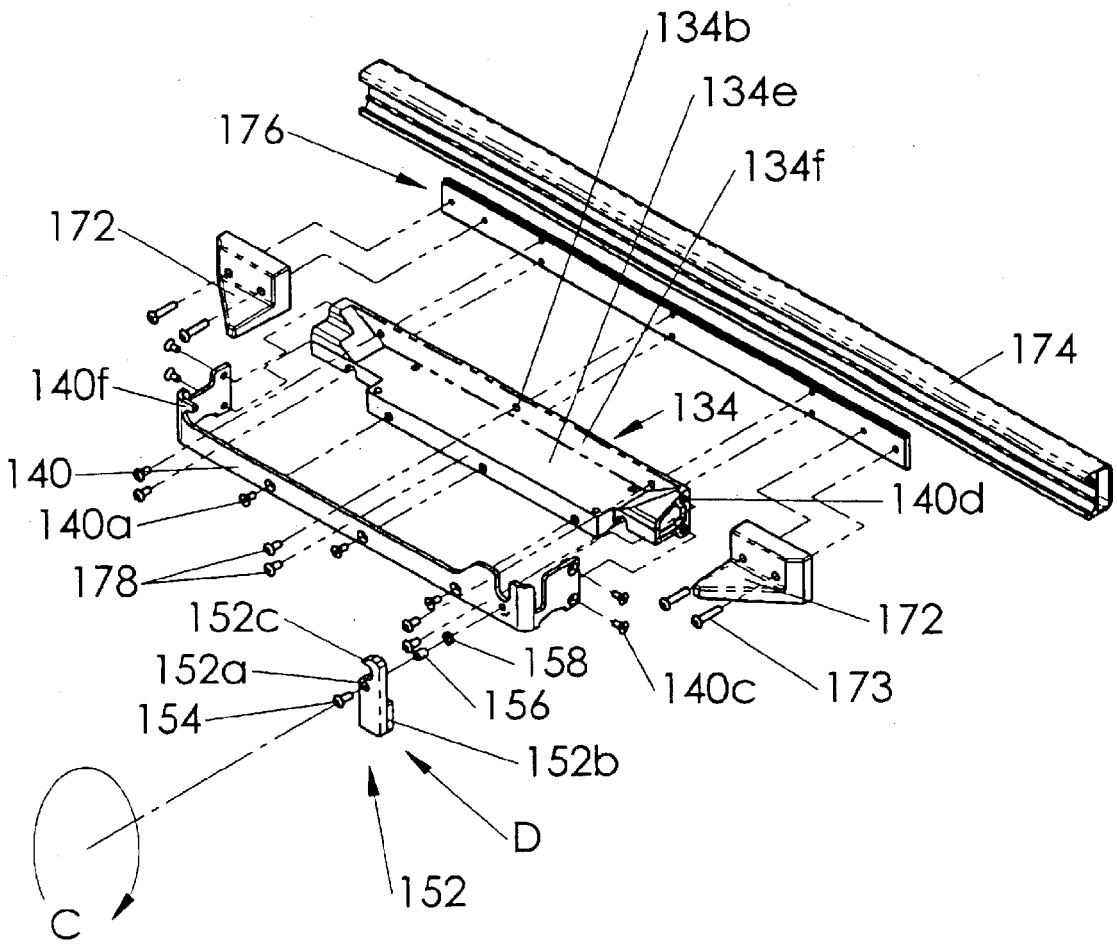
FIG. 26 is, in exploded view, the mounting bracket of FIG. 25.

In a further alternative embodiment of the invention incorporating the latch mechanism described above, seen in FIGS. 25, 25*a* and 26, mounting bracket 134 is adapted for mounting to the side rail of a Stryker stretcher which uses a rectangular rail 174 in its construction rather than a tubular rail. Mounting bracket 134 is fastened to member 176 by a plurality of bolts 178 which are journalled through apertures in rear surface 134*f* of mounting bracket 134 both above (shown) and below (not shown) upper surface 134*e*. Member 176 has both an upper linear rail flange 176*a* and a lower linear rail flange 176*b*, best seen in the enlarged view of FIG. 25*a*. Stretcher side rail member 174 has an upper lip 174*a* and a lower lip 174*b* forming a linear channel 174*c*, such that when member 176 is inserted into cavity 176*c*, the upper and lower flanges 176*a* and 176*b* may be slid along the channel, releasably locked in place behind upper and lower lips 174*a* and 174*b*, respectively. The corresponding lengths of the plastic side finish (not shown) ordinarily inserted into and along channel 174*c* may be cut and removed to allow mounting of the length of member 176 holding bracket 134 and end pieces 172 end-to-end between lengths of the side finish in rail members 174.

In further embodiments of the invention, not illustrated, one large annular clamp or large collar, as the case may be, may take the place of annular clamps 42 and 44, or collars 42' and 44', to hold canister 60 in place. Alternatively, the pair of annular clamps or collars may not be mounted parallel but rather one or both may be mounted at an angle while still maintaining corresponding first and second apertures defined by the clamps or collars and being co-axial along a longitudinal axis of canister 60 when mounted journalled in the clamps or collars.

Figure 32:
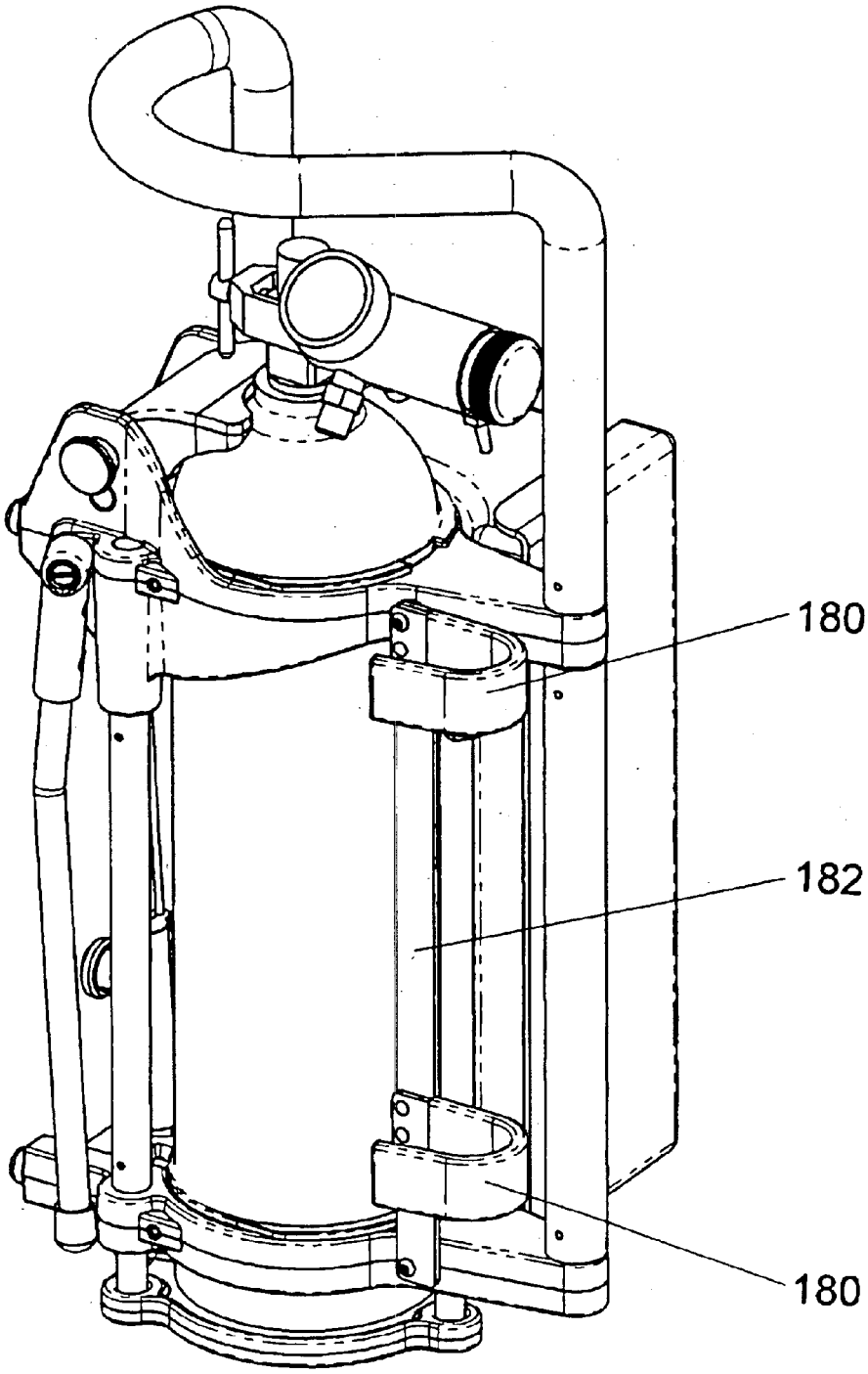
FIG. 32 is an isometric view of the mounted canister retaining frame as viewed from the opposite side shown in FIG. 31.

In the alternative embodiment of FIG. 32, the means for mounting the canister retaining frame to a rigid support member of a stretcher may include hooks 180. Hooks 180 are mounted to the frame by means of a mounting bracket, such as crossbar 182. Hooks provide for releasable mounting of the frame carrying the oxygen canister to one end of a stretcher frame such as member 130.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A quick release supporting apparatus for a canister for releasable mounting to a medical patient transporter having a rigid support member, said apparatus comprising:

a mounting bracket and a mounting means for mounting said mounting bracket to said rigid support member so that said mounting bracket is mountable by said mounting means to said rigid support member, said mounting bracket mountable to a rigid, canister retaining frame, said retaining frame defining a rigid cavity having an opening for receiving a gas canister substantially completely into said cavity, a portion of said retaining frame providing a means for carrying of said retaining frame by a user when the canister is mounted in said cavity, wherein said frame includes at least one collar, and a corresponding at least one aperture defined by said at least one collar, said at least one aperture being co-axial with a longitudinal axis of the canister when the canister is mounted journalled in said at least one collar.

2. The apparatus of claim 1 wherein said means for carrying includes a carry handle.

3. The apparatus of claim 1 further including at least one latch cooperating between said mounting bracket and said retaining frame for releasable mounting into mating engagement of said retaining frame with said mounting bracket.

4. The apparatus of claim 3 further comprising a manually operable release actuator cooperating with said at least one latch for selective actuation of said at least one latch to release said retaining frame from said mounting bracket.

5. The apparatus of claim 4 wherein said mourning bracket includes an elongated rigid base having a mating surface recessed therein for receiving said retaining frame into conformal mating engagement.

6. The apparatus of claim 5 wherein said mounting bracket comprises first and second opposite ends wherein said first end has a fixed hook in opposed facing relation to a corresponding latch book on said at least one latch.

7. The apparatus of claim 5 wherein said mounting bracket includes a plate comprising first and second opposite ends wherein said first end has a fixed hook in opposed facing relation to a corresponding latch book on said at least one latch.

8. The apparatus of claim 5 wherein said mounting means includes an elongated member adapted for mating with said mounting bracket and said rigid support.

9. The apparatus of claim 8 wherein said elongated member is clamped to said rigid support member by a clamping means such that said elongated member cannot rotate around said rigid support member.

10. The apparatus of claim 8 wherein said elongated member comprises a pair of linear and parallel oppositely disposed flanges for sliding mating into and along a correspondingly shaped channel in said rigid support.

11. The apparatus of claim 1 wherein said at least one collar comprises first and second collars mounted parallel and spaced apart, corresponding first and second apertures defined by said collars being co-axial along a longitudinal axis of the canister when mounted journalled in said collars.

* * * * *